US005988558A

United States Patent [19]

Koike et al.

[11] Patent Number: 5,988,558

[45] Date of Patent: Nov. 23, 1999

[54] VENEER REELING APPARATUS

[75] Inventors: Masaru Koike; Yukinobu Kuno, both of Aichi, Japan

[73] Assignee: Meinan Machinery Works, Inc., Aichi, Japan

[21] Appl. No.: 09/197,962

[22] Filed: Nov. 23, 1998

[51] Int. Cl.[6] ..... B65H 18/08

[52] U.S. Cl. ..... 242/534; 242/541.5; 242/541.7; 242/547

[58] Field of Search ..... 242/534, 534.2, 242/541, 541.4, 541.5, 541.6, 541.7, 547

[56] References Cited

U.S. PATENT DOCUMENTS

| | | | |
|---|---|---|---|
| 3,334,834 | 8/1967 | Davidson et al. | 242/541 |
| 4,181,269 | 1/1980 | Ketteler et al. | 242/541.5 |
| 4,273,300 | 6/1981 | Wojtowicz et al. | 242/534.2 |
| 4,532,750 | 8/1985 | Meier | 242/541 |
| 4,883,233 | 11/1989 | Saukkonen et al. | 242/534.2 |
| 4,921,183 | 5/1990 | Saukkonen et al. | 242/541.7 |
| 4,995,563 | 2/1991 | Kalin | 242/534 |
| 5,320,299 | 6/1994 | Fitzpatrick et al. | 242/541.6 |

FOREIGN PATENT DOCUMENTS 57-53306 3/1982 Japan .

*Primary Examiner*—Donald P. Walsh
*Attorney, Agent, or Firm*—Morgan & Finnegan L L P

[57] ABSTRACT

A veneer reeling apparatus for winding a veneer sheet into a veneer roll comprising a freely rotatable take-up reel around which the veneer sheet is wound into the veneer roll, and an array of spaced conveyer belts extending below the take-up reel for advancing the veneer sheet toward the take-up reel. Veneer sheet is transferred by the plurality conveyer belts which include two groups of such belts and extending below the take-up reel. Air cylinder is provided for each belt to provide a first force to urge the belt toward the take-up reel so as to keep the belt in resiliently pressing contact with the veneer roll. The air cylinders are operable to changeably provide the first force to one group of belts and a second force, which is smaller than the first force, to the other group of belts, and vice versa. A control is provided to effect alternate changing between the first and second pressures in the first and second groups of belts whenever the belts have moved a predetermined distance.

18 Claims, 16 Drawing Sheets

VENEER REELING APPARATUS

FIELD OF THE INVENTION

The present invention relates to an apparatus reeling or winding a sheet of wood veneer into a roll while the sheet is being transferred to the apparatus with its fiber orientation directed perpendicularly to the direction in which the sheet is transferred.

BACKGROUND OF THE INVENTION

For understanding of underlying problems of the invention, firstly reference is made to FIG. 32 schematically showing a conventional veneer reeling apparatus which is disclosed by Publication of Unexamined Japanese Patent Application (Kokai) 57-53306 of 1982.

This apparatus has a plurality of endless belts 151 for conveying veneer sheet 150, each trained round a driven front pulley disposed swingable as indicated by double-headed arrow about a pivotal axis defined by a rear pulley (not shown) located on opposite side of the belts 151. The reeling apparatus further includes a take-up reel 153 extending above the upper legs of the belts 151 for winding thereround veneer sheet 150 into a roll 154 and a plurality of sectional touch rolls 152 mounted on a shaft provided just below the reel 153. Each sectional touch roll 152 is located between any two adjacent belts 151 and driven to rotate at a peripheral speed that is slightly higher than the traveling speed of the conveyer belts 151. The shaft carrying the touch rolls 152 is resiliently supported, as indicated by double-headed arrow, and urged so as to make the touch rolls 152 to be in pressing contact with veneer roll 154.

In the above apparatus, veneer reeling is accomplished by rotating the veneer roll 154 by frictional force from the touch rolls 152 pressed thereagainst with a force that is large enough to effect the rotation. Because the veneer roll 154 and the touch rolls 152 are engaged substantially in circle-to-circle contact and hence the length of contact therebetween as seen in veneer conveying direction is rather short, the magnitude of stress resulting from the contact and acting on a unit area between the touch roll 152 and the veneer roll 154 is disadvantageously large. Consequently, the veneer sheet 150 is subjected at the point of contact to a stress that tends to strain or deform the sheet.

On the other hand, a veneer sheet 150 as peeled by a veneer lathe (not shown) comes out therefrom inherently in such a form that the sheet is waved at short intervals. Further, veneer sheet 150 is formed in the lower surface thereof with a number of small cracks, usually called "lathe checks", produced during peeling operation. Thus, veneer sheet generally tends to be deformed easily when it receives an external force. Additionally, because a wood veneer sheet is of heterogeneous quality, such deformation takes place variably from one location thereof to another along the line of contact between the veneer sheet and the touch rolls 152 even when it is subjected to application of the same force.

When subjected to the above straining or deforming stress at the touch rolls 152, veneer sheet 150 is stretched or extended in the region upstream of the touch rolls 152. Because this extension takes place variably from one location to another of the veneer sheet 150 across the direction in which it is moved, sheet movement tends to be deviated from a straightforward course along the belts 151, with the result that veneer sheet 150 may collide against a frame of the reeling apparatus, thus causing a damage to veneer sheet 150. Furthermore, any excessive extension of veneer sheet 150 causes slack in the sheet as indicated by 150*a*, which may result in formation of folds. If veneer sheet 150 is wound as folded round the roll 154, the sheet is broken at bends of the folds, thereby affecting the veneer quality and yield.

SUMMARY OF THE INVENTION

Therefore, it is an object of the invention to provide a veneer reeling apparatus which makes possible smooth reeling operation without allowing veneer sheet to be folded or deviated from its intended course along conveyer belts so that damage to veneer sheet and reduction in veneer quality and yield as described above are prevented.

According to the invention, there is provided a veneer reeling apparatus for winding a veneer sheet into a veneer roll, which comprises a freely rotatable take-up reel round which the veneer sheet is wound into the veneer roll, and an array of spaced conveyer belts extending below the take-up reel in perpendicular relation to the axis of the reel for advancing the veneer sheet toward the take-up reel. In a preferred embodiment of the invention, the array of belts includes a first group of belts arranged on one lateral side of the array and a second group of remaining belts arranged on the other lateral side of the array. The apparatus further comprises pressing means, preferably in the form a cylinder, arranged for each conveyer belt for providing a first force to urge the belts toward the take-up reel so as to keep the belts in resiliently pressing contact with the veneer roll. The pressing means is operable to changeably provide the first force to one group of belts of the first and second groups and a second force, which is smaller than the first force, to the other group of the belts. A control is provided which is operable on the pressing means to controllably change the application of the first or second force to one group or the other group of belts in an alternate manner, i.e. application of the first force to the first group of belts and of the second force to the second group of belts, then followed by application of the second force to the first group of belts and of the first force to the second group of belts, and so forth. The control generates a signal whenever the belts have moved a predetermined distance of, for example, about 500 mm to effect the above changing between the first and second forces.

The pressing means includes a swingable plate disposed on underside of the belt and an air cylinder with a piston rod which is operable on the belt by way of the swingable plate. Alternatively, the pressing means may include a swingable plate disposed on underside of the belt, a compression spring below the swingable plate and a cam which is operable on the belt by way of the compression spring and the swingable plate.

While in the preferred embodiment the changing between the first and second forces from the pressing means takes place alternately, it may be so arranged that the changing between the first and second forces may be performed with a such time-lag that the changing from the first to second force occurs only after the changing the second force to the first force so that all the belts receive the first force for a period of time corresponding to the above time-lag.

As a modified embodiment, the second force may be of a magnitude that applies no force to the belt.

The array of belts may be arranged so as to include a third group of at least one belt between the first and second groups of belts and the pressing means may provide a force, which is smaller than the first force and greater than the second force, to urge the belt of the third group toward the take-up reel so as to keep the belt in resiliently pressing contact with the veneer roll.

It may be so arranged that the pressing means normally provides the first force to keep the belt in resiliently pressing contact with the veneer roll, but it is operable to change the first force to the second force in response to a regularly generated signal from the control.

Additionally, changing of the first force to the second force may be effected from a signal provided by a limit switch which is disposed to detect the presence of any raised portion or slack formed in the incoming veneer sheet.

The apparatus according to the preferred embodiment of the invention further comprises means for moving the take-up reel toward and away from the belts and means for detecting an increment in diameter of the veneer roll during reeling operation. The detecting means is operable to generate a signal in response to detection of a predetermined amount of increment in diameter of the veneer roll and the control responding to the signal from the detecting means generates a command signal to activate the take-up reel moving means thereby to move the take-up reel away from the belts so as to compensate for the increment in diameter of the veneer roll.

The above and other objects, features and advantages of the invention will become apparent to those skilled in the art from the following description of embodiments of the veneer reeling apparatus according to the present invention, which description is made with reference to the accompanying drawings, wherein:

DETAILED DESCRIPTION OF PREFERRED EMBODIMENTS

Figure 1:
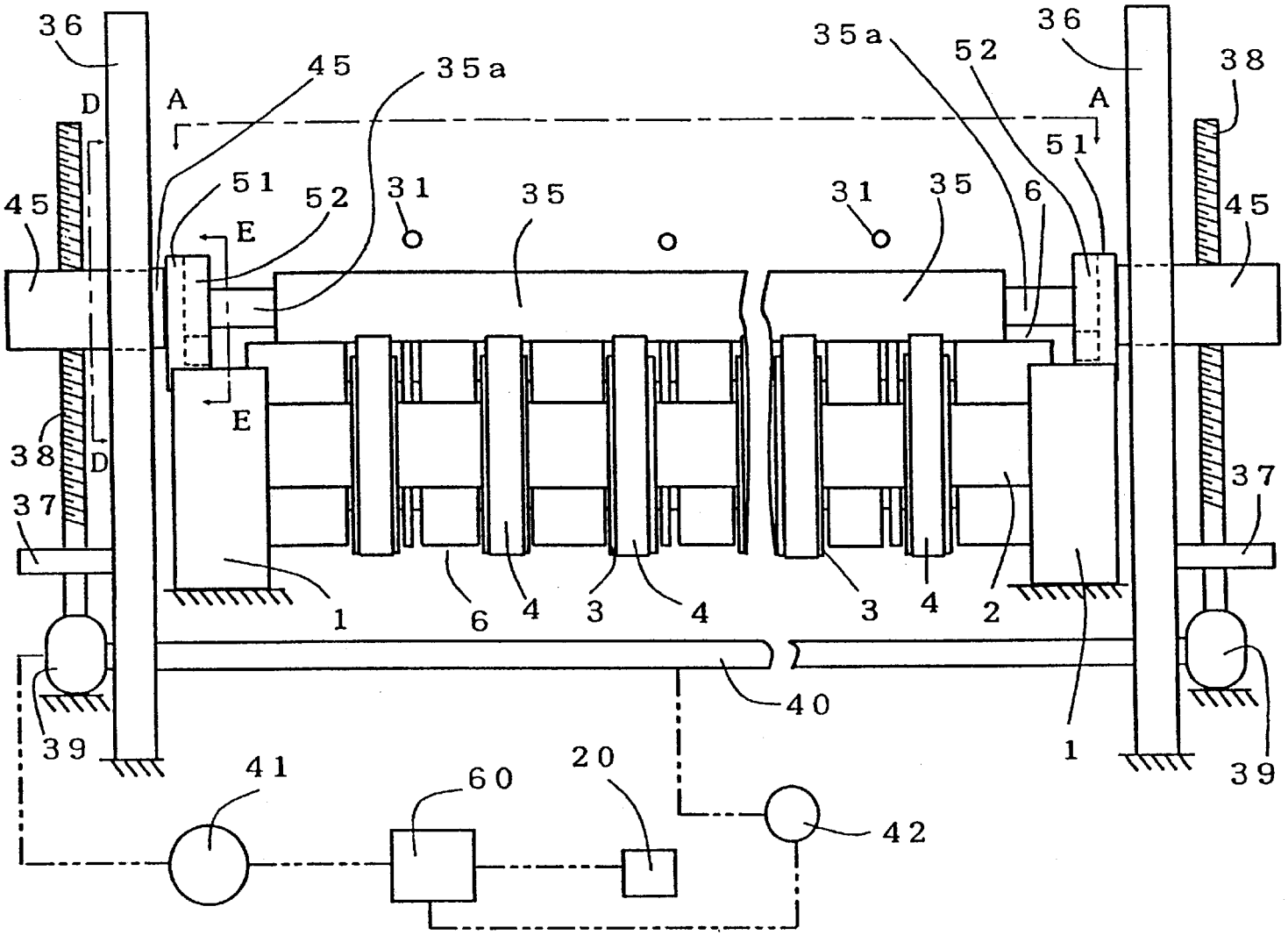
FIG. 1 is a front view of a preferred embodiment of veneer reeling apparatus constructed according to the present invention.
Figure 2:
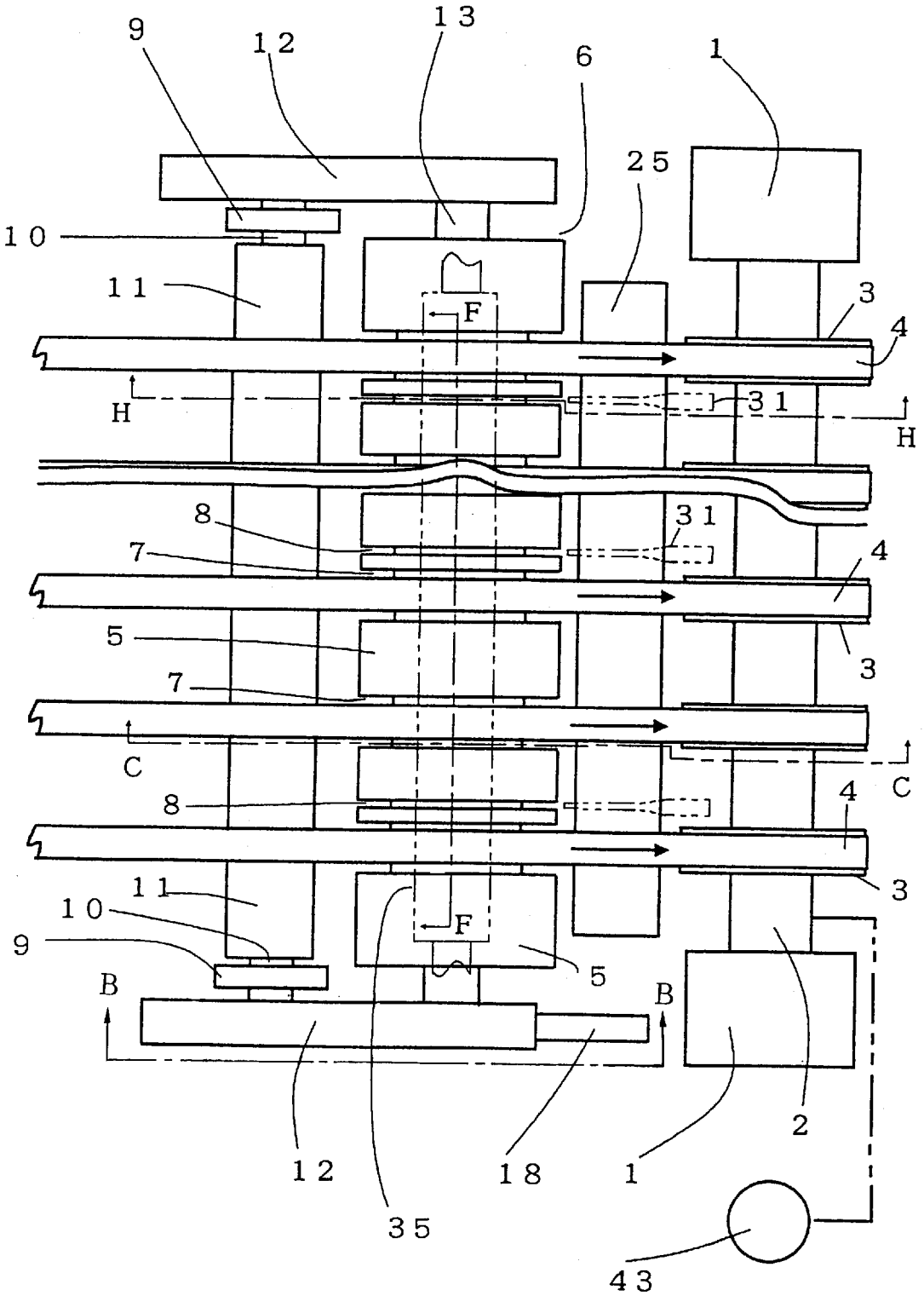
FIG. 2 is a fragmentary plan view as seen in arrow direction from dash-and-dot line A—A of FIG. 1.

Reference is made to the accompanying drawings, specifically to FIGS. 1 to 15 showing a first preferred embodiment of the present invention. As shown in FIGS. 1 and 2, the veneer reeling apparatus includes a plurality of spaced endless conveyer belts 4, or eight belts in the illustrated embodiment, although only five of them are shown in the drawings. Each belt 4 is trained round a front pulley 3 mounted on a common drive shaft 2 rotatably supported by bearings 1 fixedly mounted to a frame and driven by a motor (not shown). Each belt 4 is also trained round a rear pulley (not shown) mounted on a freely rotatable shaft (not shown either), so that a veneer sheet 65 placed on the belts 4 is transferred forward as indicated by arrows in FIG. 2. As schematically shown in FIG. 2, a rotary encoder 43 is provided for monitoring the rotational speed of the shaft 2, and hence the traveling speed of the conveyer belts 4. Though not shown in FIG. 2, the rotary encoder 43 is electrically connected to a control 60 (FIG. 1) of the apparatus.

The apparatus further comprises a take-up reel 35 extending above and across the upper legs of the belts 4 for winding thereround a veneer sheet 65 (FIG. 13) into a roll 66 (FIG. 14) and a touch roll assembly 6. The latter assembly 6 has a freely rotatable shaft 13 located upstream of the front pulley shaft 2 and a plurality of spaced touch rolls 5 carried on the shaft 13. The touch rolls 5 are clad with urethane rubber covering and spaced from one another such that annular grooves 7 and 8 are formed between any two adjacent touch rolls, as most clearly shown in FIG. 2, so as to provide spaces for the belts 4 to run in and for the tip end of a thread nozzle 31 to enter, as will be described in a later part hereof.

Figure 4:
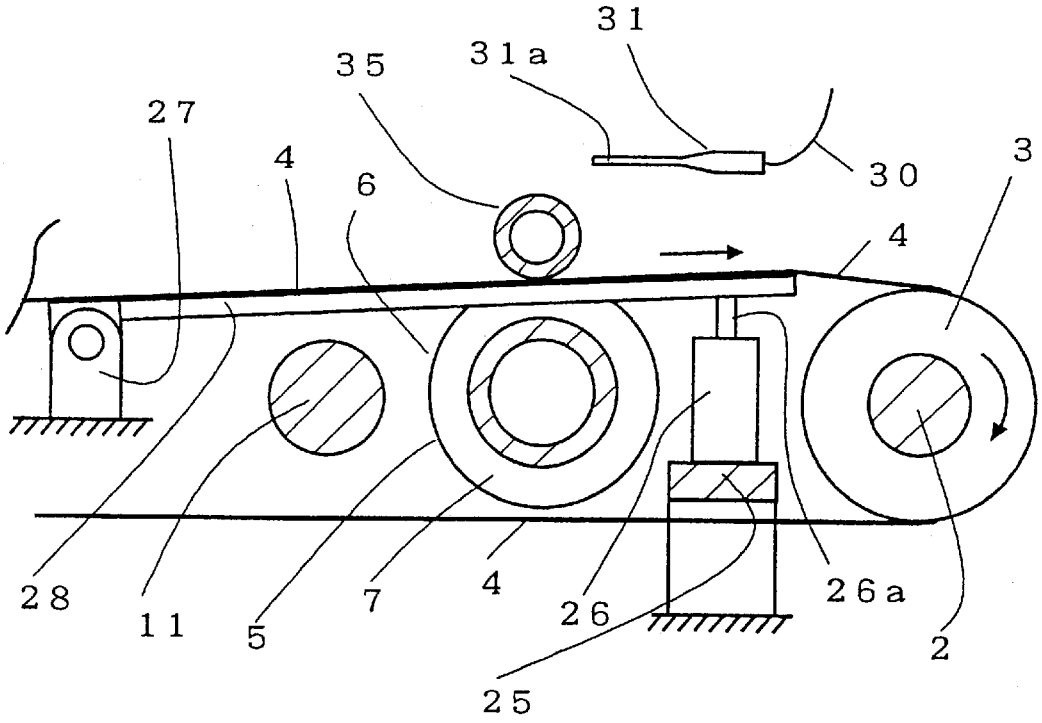
FIG. 4 is a fragmentary side view as seen in arrow direction from dash-and-dot line C—C of FIG. 2.

As shown in FIGS. 2 and 4, upstream of the touch roll assembly 6 is located a bar 11 mounted on a shaft 10 rotatably supported at opposite ends thereof by bearings 9 fixed to a frame (not shown) of the apparatus. The shaft 10 carries at each end thereof a swingable first arm 12 for rotation with the shaft 10.

Figure 3:
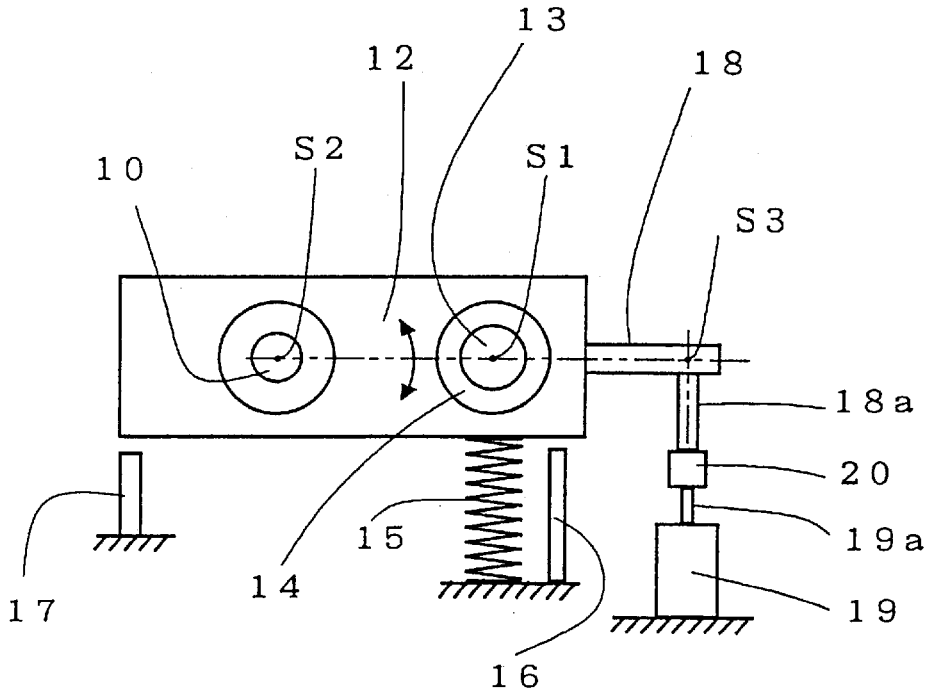
FIG. 3 is a schematic side view showing part of the apparatus of FIG. 1, as seen in arrow direction from dash-and-dot line B—B of FIG. 2.

As shown in FIG. 3, the shaft 13 of the touch roll assembly 6 is rotatably supported at the opposite ends thereof by bearings 14 provided in the first arms 12, so that the shaft 13 is vertically movable with swinging motion of the first arms 12 about the shaft 10. An L-shaped second arm 18 having a vertical portion 18*a* is fixedly mounted to one of the first arms 12, or the right-hand side arm as viewed in veneer conveying direction. There is provided a compression spring 15 between each first arm 12 and frame of the apparatus for supporting the first and second arms 12, 18 and the touch roll assembly 6 such that the first arms 12 are maintained in a substantially horizontal position. Reference numerals 16 and 17 designate stops for limiting rotation of the first arm 12 in clockwise and counterclockwise directions, respectively.

Just below the vertical portion 18*a* of L-shaped second arm 18 is located a pneumatic cylinder 19 with a piston rod 19*a*. The piston rod 19*a* has fixed at its outer end a load cell 20 for monitoring a force applied thereto and operable to generate a signal to the control 60 when the load cell 20 detects a force of predetermined magnitude. The cylinder 19 is charged with air under pressure, the magnitude of which is such that the piston rod 19*a* exerts a predetermined upward force to the second arm 18 via the load cell 20 that allows the touch rolls 5 to be pressed against the take-up reel 35, or veneer roll 66 when such a roll has been already formed (FIG. 14), with a force of about 5 kilograms. Such predetermined upward force effected by thus charging the air cylinder 19 shall be referred to as "set upward force" hereinafter.

Incidentally, this "set upward force" may be obtained by charging the cylinder 19 with air under pressure acting on the piston rod 19*a* upwardly with a force that is equivalent to 5 kilograms times quotient obtained by dividing distance S1–S2 by distance S2–S3, wherein S1 and S2 denote axial centers of the shaft 13 of the touch roll assembly 6 and of the shaft 10, respectively, as seen in FIG. 3, and S3 represents a point of intersection between an imaginary line connecting S1 and S2 and another imaginary line passing through the center of the vertical portion 18*a* of the second arm 18.

After air under the above pressure is charged in the cylinder 19, both inlet and outlet ports of the cylinder are sealingly closed with its piston rod 19*a* fully extended. By so doing, air within the cylinder 19 is compressed when an external force is applied to the load cell 20 to push the piston rod 19*a* downward and the piston rod 19*a* then exerts a reaction force in opposing or upward direction that is greater than the above set upward force and commensurate with the magnitude of the above external force and hence to the distance for which the piston rod 19 is pushed. This reaction force is detected by the load cell 20, which in turn generates to the control 60 a signal representative of the magnitude of such reaction force. The vertical portion 18*a* and the piston rod 19*a* have such longitudinal dimensions that a slight clearance is formed therebetween when no external force is applied to the load cell 20.

Referring now to FIGS. 2 and 4, there is provided a support base 25 extending between the front pulley 3 and the touch roll assembly 6 and straddling the lower legs of the conveyer belts 4. The support base 25 has an air cylinder 26 fixed thereto in association with each belt 4. Each belt 4 has on its inner surface a backup plate 28 having substantially the same width as the belt 4 and rotatably supported at the upstream end thereof by a bearing 27.

As described earlier, the apparatus shown in FIGS. 1 and 2 has an array of eight conveyer belts 4. It is noted that these belts 4 are arranged in two groups, namely, four belts located on the left-hand side as seen in veneer conveying direction which will be referred to as belts of a first group, while the remaining four belts on the right-hand side as belts of a second group.

Figure 5:
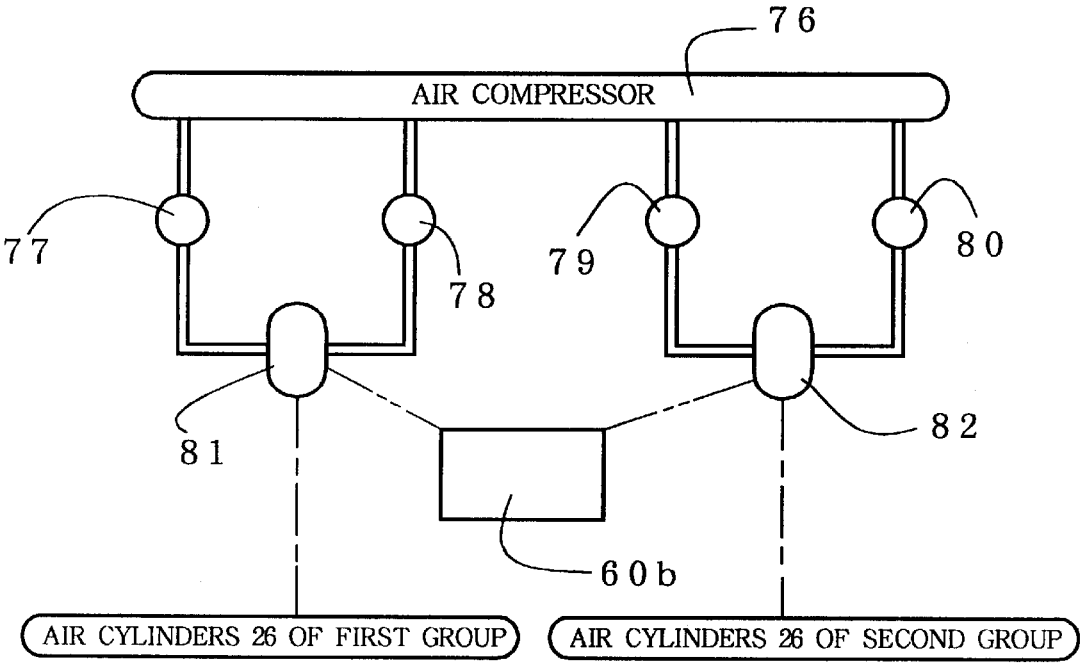
FIG. 5 is a schematic diagram showing a pneumatic system of the veneer reeling apparatus of FIG. 1.

Now referring to FIG. 5, the apparatus includes an air compressor 76 connected to two pairs of reducing valves 77, 78 and 79, 80 which are in turn connected to solenoid-operated valves 81, 82, respectively, for selectively changing the flow passages of air under reduced pressure. The solenoid valves 81, 82 are operatively connected to the air cylinders 26 for the conveying belts 4 of the first and second groups, respectively. For the sake of description, the cylinders 26 for the belts 4 of the first and second groups are referred to as cylinders of the first and second groups, respectively. The solenoid valves 81, 82 are electrically connected to the control 60. The reducing valves 77 and 79 adjust the pressure of air from air compressor 76 to a first pressure, while the reducing valves 78 and 80 regulate the pressure to a second pressure. The first pressure adjusted by the reducing valves 77, 79 is of such a magnitude that, when introduced into each air cylinder 26 for the belt 4 of either one of the groups, allows each such belt 4 to exert a pressing force of about 5 kilograms against the take-up reel 35 or veneer roll 66, hence 20 kilograms by four belts. On the other hand, the second pressure from the reducing valves 78, 80 is of such a magnitude that only supports the plate 28 for each belt 4 and allows each belt to exert very little pressing force against the take-up reel 35 or veneer roll 66.

Figure 8:
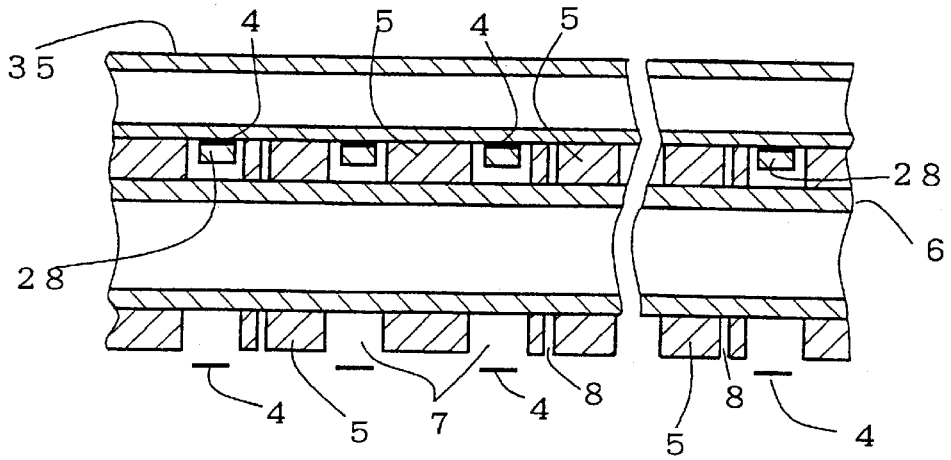
FIG. 8 is a fragmentary front view as seen in arrow direction from dash-and-dot line F—F of FIG. 2.

FIGS. 4 and 8 show initial state of the apparatus, illustrating the position of the take-up reel 35 relative to the touch rolls 5, which state will be detailed in later part hereof. In this initial state condition, the piston rod 26*a* of each cylinder 26 is extended partially out of its cylinder 26 and engaged in pressing contact with its associated plate 28. Therefore, when the take-up reel 35 is moved slightly upward from the this initial state condition, the piston rod 26*a* can extend further to keep contact engagement with the plate 28, thereby allowing the belts 4 to be in pressing contact with the reel 35. It is also noted that, unlike the air cylinder 19, each air cylinder 26 is so arranged that the force with which each belt 4 presses against the take-up reel 35, or against veneer roll 66, will not be varied remarkably by slight movement of the piston rod 26*a* relative to its cylinder 26. Such arrangement may be accomplished by sealing the outlet ports of the cylinders 26, but connecting the inlet ports thereof to the above reducing valves 77, 78, 79, 80 via relative long pneumatic lines so that a larger amount of air must be compressed by downward movement of the piston rod 26*a*. Thus, the conveyer belts 4 in operation are moved in arrow direction while being forced pushed upward by the plates 28 as shown in FIG. 4.

As indicated by phantom lines in FIG. 2, a plurality of thread nozzles 31 is disposed adjacent the take-up reel 35 at locations corresponding to the respective grooves 8. Each nozzle 31 has an end 31*a* whose outer diameter is smaller than the width of the groove 8 so as to be inserted thereinto as required. The nozzle 31 is operable to initially eject a thread 30 from the end 31*a* by air jet and then to allow the thread 30 to be pulled out tautly during veneer reeling operation. Furthermore, each thread nozzle 31 is movable by any appropriate means such as air cylinder in both vertical and horizontal directions, as will be described later in more detail.

Referring back to FIG. 1, a pair of uprights 36 is located adjacent the opposite ends of the touch roll assembly 6, and a pair of screws 38 operatively connected by a shaft 40 via bevel gears 39 is provided adjacent the uprights 36. A servo-motor 41, which is operable from a signal provided by the control 60, is connected to one of the bevel gears 39 for rotating both screws 38 synchronously. A rotary encoder 42 is operatively connected to the shaft 40 for counting the number of rotations thereof thereby to determine the distance that the take-up reel 35 has moved from its initial state position as will be explained hereinafter. This rotary encoder 42 is also connected to the control 60.

Figure 6:
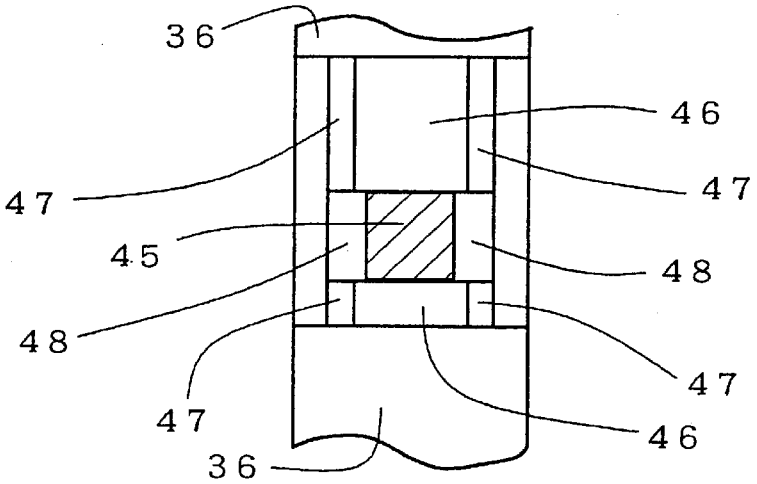
FIG. 6 is a fragmentary side view as seen in arrow direction from dash-and-dot line D—D of FIG. 1.
Figure 7:
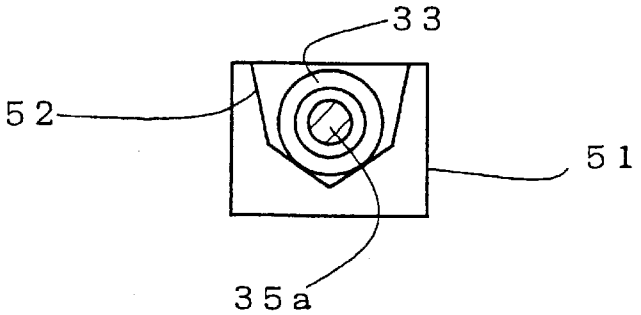
FIG. 7 is a schematic side view as seen in arrow direction from dash-and-dot line E—E of FIG. 1.

A support block 45 having formed therein internal thread (not shown) is engaged with each screw 38 and disposed through an opening 46 formed in each upright 36 for guided movement along vertical guide surfaces 47 by the aid of linear bearings 48 fixed to the support block 45, as shown in FIG. 6. A take-up reel carriage 51 is fixed to the inner end of each support block 45. The reel carriage 51 has formed therein a V-shaped support surface 52 for supporting a bearing 33 mounted at each end of a shaft 35*a* on which the take-up reel 35 is fixedly mounted, as schematically shown in FIG. 7. By so arranging, the take-up reel 35 is rotatable relative to the carriages 51 and movable vertically with the support blocks 45 along the screws 38 while maintaining parallel relation to the touch roll shaft 13. To prevent the bearings 33 from being lifted off the V-shaped support surfaces 52 by upward force exerted by the belts 4 and the touch rolls 5, the take-up reel 35 is constructed heavy enough to resist such upward force. As it is apparent to those skilled in the art, the take-up reel 35 is removably carried on the carriages 51.

The control 60 receiving various signals from load cell 20, rotary encoders 42, 43 is operable on the motor 41 and the solenoid valves 81, 82, as follows.

When load detected by the load cell 20 is increased to exceed the above set upward force of the cylinder 19 by about 10 percent while the carriages 51 are moving downward with the pulley drive shaft 2 kept at a stop, which stop condition is detected by the rotary encoder 43, the control 60 then responding to a signal from the load cell 20 representative of such an increase of the load generates a signal commanding the motor 41 to stop and then to operate so as to rotate the screws 38 in the direction that causes the carriages 51 to be elevated until the load detected by the load cell 20 becomes smaller than the set upward force of the cylinder 19.

On the other hand, when the load detected by the load cell 20 is increased exceeding the set upward force of the cylinder 19 by about 10 percent while the pulley drive shaft 2 is being rotated and also if the detected load continues to be so while the take-up reel 35 rotates for a period of time corresponding to a predetermined rotation angle, e.g. a quarter of a complete turn of the reel 35, the control 60 generates a signal commanding the motor 41 to operate to rotate the screws 38 in the direction that causes the carriages 51 to be elevated. This elevation is continued until the load detected by the load cell 20 becomes smaller than the set upward force of the cylinder 19 and also if this condition continues to be so while the take-up reel 35 makes a quarter turn.

While the front pulley shaft 2 is running, the control 60 calculates traveling distance of the belts 4 in accordance with information of time elapsed and the traveling speed of the belts 4 obtainable from the rotary encoder 43, and generates a signal to actuate the solenoid-operated valves 81, 82 whenever the belts 4 have moved a predetermined distance, e.g. 500 mm, changing the air flow passages so that the first pressure is supplied to the cylinders 26 of one of the first and second groups while the second pressure is supplied to the cylinders 26 of the other group of the first and second groups. Such complementary alternate operation of the solenoid valves 81, 82 is effected each time the belts 4 move the above distance of 500 mm.

Since the conveyer belts 4 travel substantially at a constant speed, time t during which the take-up reel 35 makes a quarter turn is lengthened with an increase in diameter of veneer roll 66. Incidentally, the time t can be figured out as follows. The distance that the outer periphery of veneer roll 66 moves during the length of time t is zt, wherein z represents the speed at which the belts 4 move, and the circumference of veneer roll 66 is expressed by $2\pi(x+y)$, wherein x represents the distance for which the carriages 51 are moved from their initial state position and y the radius of the reel 35, thus (x+y) represents the current radius of veneer roll 66. Since zt corresponds to a quarter of $2\pi(x+y)$, t is expressed by $2\pi(x+y)/2z$. In operation, the time t is calculated by the control 60 which receives information on the distance x measured by the rotary encoder 42 and the speed z monitored by the rotary encoder 43.

It is noted that the control 60 is operable also from various signals generated by manual operation on a control panel (not shown) of the apparatus by machine operator for manually controlling the operation of various devices including, but not limited to, servo-motor 41, front pulley shaft motor, solenoid valves 81, 82 and nozzles 31.

The following will describe the steps of procedure for setting the apparatus in its initial state condition.

Firstly, the solenoid valves 81. 82 are operated by a manual signal from the control 60 so that the first pressure is supplied to the air cylinders 26 of the first group while the second pressure is applied to the cylinders 26 of the second group. Machine operator then manually starts the motor 41 to rotate the screws 38 so as to bring the carriages 51 to a position higher than that shown in FIG. 1. The take-up reel 35 is installed and set in position by placing its bearings 33 on V-shaped support surfaces 52 of the carriages as shown in FIG. 7. The screws 38 are rotated by manually operating the motor 41 to lower the carriages 51, allowing the take--up reel 35 to be brought into contact with the conveyer belts 4 and the touch rolls 5. By allowing the take-up reel 35 to move further downward, the touch rolls 5 and the belts 4 are forced downward and, therefore, the first arms 12 carrying the shaft 13 for the touch rolls 5 are caused to swing clockwise as seen in FIG. 3 and the lower end of the vertical portion 18*a* of the second arm 18 presses the load cell 20. Consequently, the piston rod 19*a* to which the load cell 20 is attached is pushed into the cylinder 19 and air under pressure within the cylinder 19 is compressed. Accordingly, the piston rod 19*a* is urged upward by reaction force which is greater than the set upward force and the magnitude of which is commensurate to the extent of the above compression. Thus, the load cell 20 is subjected to a downward force from the second arm 18 and simultaneously to an upward force from the piston rod 19*a*.

As the load detected by the load cell 20 is further increased to exceed the set upward force by about 10 percent, the control 60 then responding to a signal representative of such an increase of the load generates a signal commanding the motor 41 to stop and then to operate so as to rotate the screws 38 in the direction that causes the take-up reel 35 to be elevated. As the take-up reel 35 is raised gradually, the force to push down the touch rolls 5 and hence the force acting on the load cell 20 is reduced and the piston rod 19*a* is allowed to move upward under the influence of compressed air in the cylinder 19. Therefore, the first arms 12 are swung in counterclockwise direction as seen in FIG. 3 and the touch roll assembly 6 carried by the first arms 12 is allowed to move upward while maintaining pressing contact with the take-up reel 35. As the piston rod 19*a* moves out of the cylinder 19 gradually, the force acting on the load cell 20 is reduced. As described earlier, when the load detected by the load cell 20 becomes smaller than the set upward force of the cylinder 19, the control 60 generates a signal to stop the motor 41, thus stopping the upward movement of the reel carriages 51.

As a result of the above operational procedure for establishing the initial state of the apparatus, the take-up reel 35 is set in position as shown in FIGS. 4 and 8. That is, the touch rolls 5 are engaged in pressing contact with the peripheral surface of the take-up reel 35, and the conveyer belts 4 urged by the cylinders 26 by way of the plates 28 are resiliently pressed against the reel 35. In this initial state condition, the piston rod 26*a* is extended partially out of its cylinder 26 and engaged in pressing contact with its associated plate 28 so that, when the take-up reel 35 is moved slightly upward, the piston rod 26*a* can extend further to keep contact engagement with the plate 28 for maintaining the belts 4 to be in contact with the take-up reel 35.

The following will describe veneer reeling operation of the above-described embodiment of the invention while referring to FIGS. 9 to 15.

Figure 9:
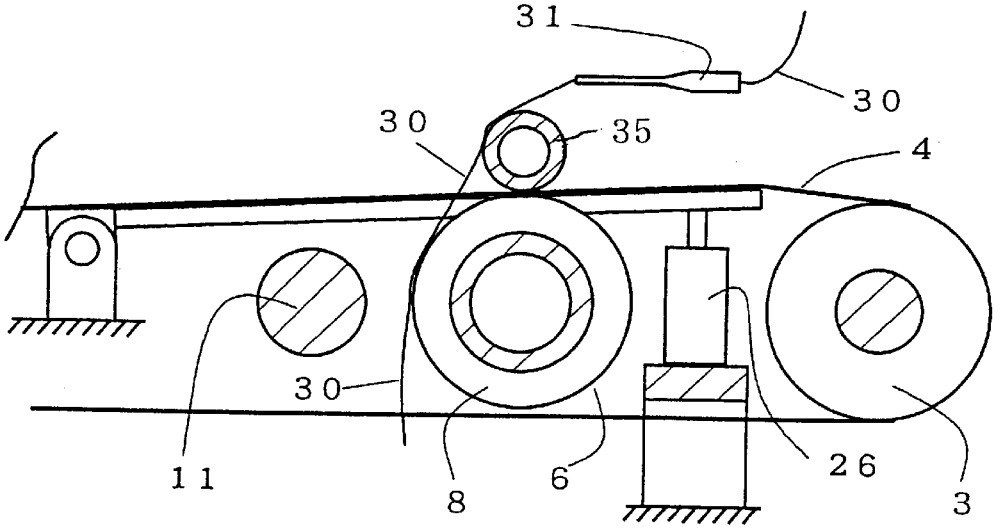
FIGS. 9 to 12 are fragmentary illustrative side views similar to that of FIG. 4, but showing movement of a thread nozzle of the apparatus.
Figure 10:
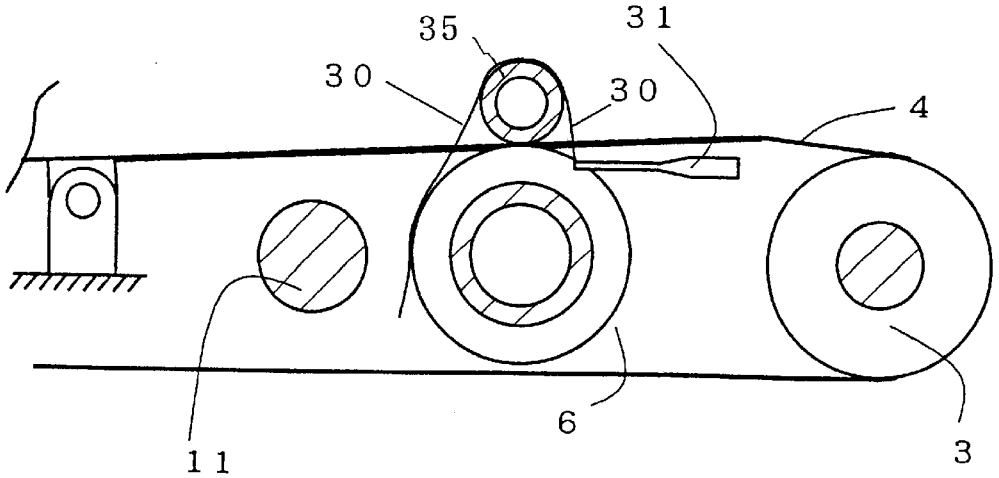
Figure 11:
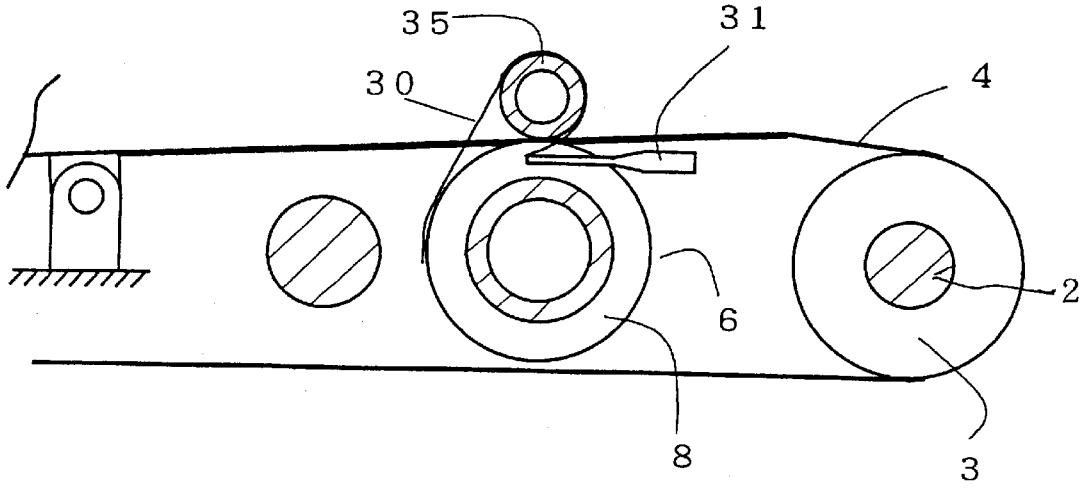

With the apparatus set in the above-described initial state shown in FIGS. 4 and 8, firstly each nozzle 31 is activated to issue an air jet with a thread 30 from the nozzle end 31*a* for a short period of time to allow the thread 30 to be positioned over the take-up reel 35 and the touch roll 5 with its leading end portion located between the touch roll 5 and the bar 11, as shown in FIG. 9. Subsequently, each nozzle 31 is moved down below the belts 4 as shown in FIG. 10 and then shifted horizontally to a position where the nozzle end 31*a* is located within the groove 8 just below the take-up reel 35 with the thread 30 drooping across the belts 4, as shown in FIG. 11. As indicated earlier, the above nozzle operations may be performed by actuating air cylinders (not shown) from manually generated signals. With the thread 30 located as shown in FIG. 11, resistance is applied to the thread 30 at any appropriate position upstream of the nozzle end 31*a* so that the thread 30 is kept taut when it is pulled out of the nozzle 31. Then, the motor (not shown) for the front pulley shaft 2 is started to initiate conveying movement of the belts 4. Therefore, the take-up reel 35 with which the belts 4 are in contact engagement is rotated by frictional force therebetween, while the touch rolls 5 engaged in pressing contact with the reel 35 are also rotated by frictional force from the reel 35.

As the front pulley shaft 2 is rotated, the control 60 calculates the traveling distance of the belts 4. After the belts 4 have moved a distance of 500 mm, the control 60 generates a signal to actuate the valves 81, 82 so that the pressure application to the cylinders 26 of the first and second groups is changed from that in the initial state condition, i.e. the first pressure is supplied to the cylinders 26 of second group while the second pressure is applied to the cylinders 26 of the first group. As stated earlier, the control 60 provides the above signal to alternately change the pressure application to the air cylinders 26 of the first and second groups whenever the conveyer belts 4 move 500 mm.

Figure 12:
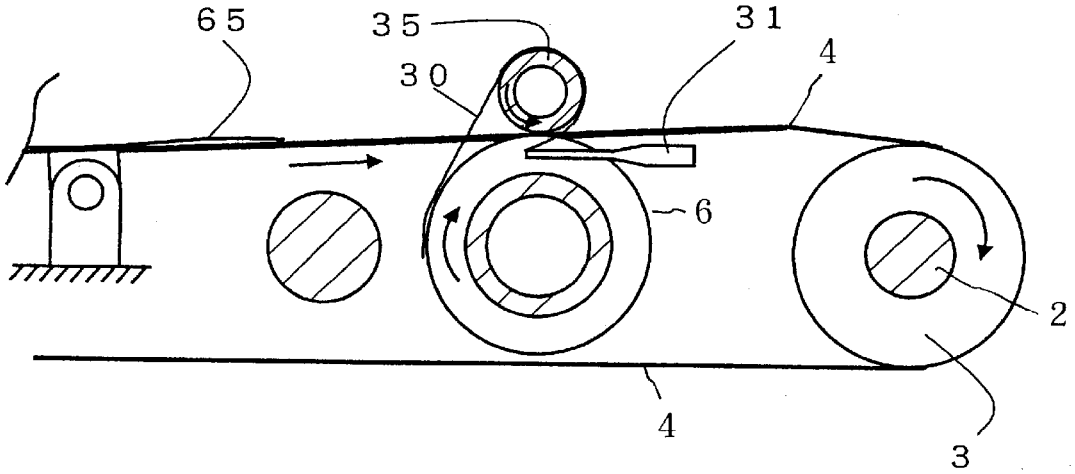
Figure 13:
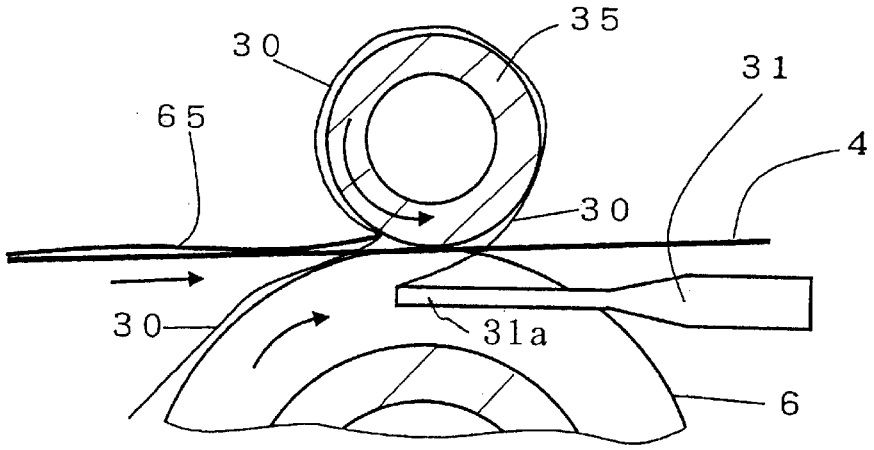
FIGS. 13 and 15 are fragmentary side illustrative views showing veneer reeling operation of the apparatus.

Referring to FIG. 12, reference numeral 65 designates a veneer sheet 65 peeled by a rotary veneer lathe (not shown) at a speed corresponding to the traveling speed of the conveyer belts 4 and having a nominal length of six feet (or about 1,800 mm) as measured along the fiber orientation of the wood veneer sheet, or across the direction in which the sheet is moved on the belts 4. When the leading end of veneer sheet 65 reaches the threads 30, the moving sheet bends the threads 30 as shown in FIG. 13. As the leading end of sheet 65 passes between the take-up reel 35 and the touch rolls 5, the thread 30 caught by the sheet leading end is held together with the veneer sheet between the take-up reel 35 and the touch rolls 5. The leading end of veneer sheet 65 is guided along the reel periphery by thread portion 30*a* extending upward from the nozzle end 31*a* to the reel periphery and wound with the thread 30 round the take-up reel 35. Then, the thread 30 is being pulled out taut and fed at a speed corresponding to the peripheral speed of veneer roll 66.

Figure 14:
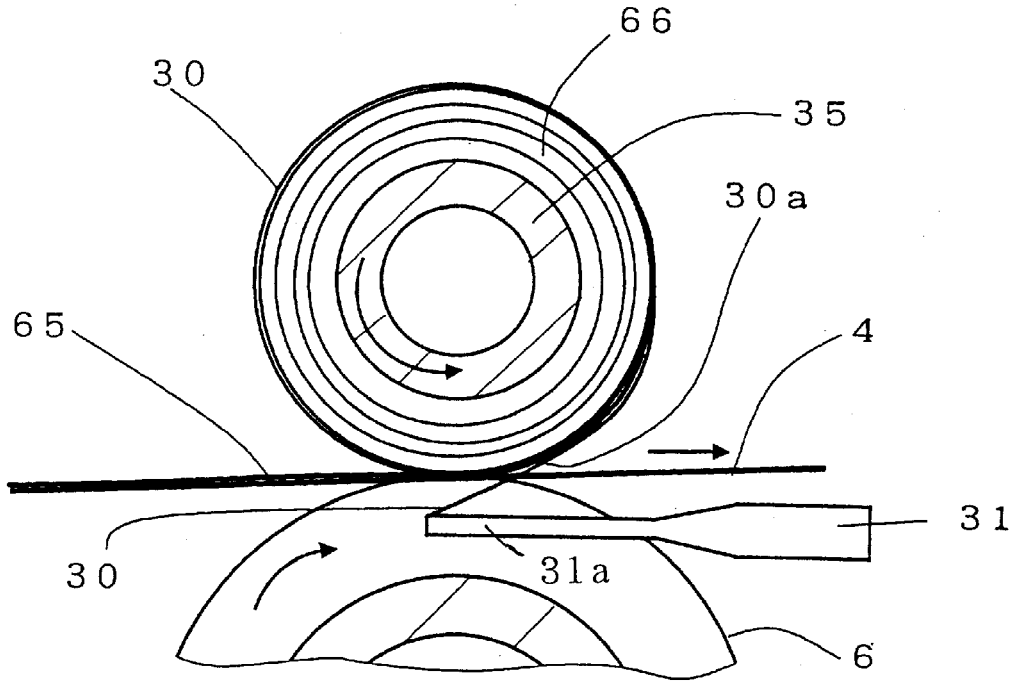

As the veneer sheet 65 is thus reeled, a veneer roll 66 with a progressively increasing diameter is formed round the take-up reel 35 as shown in FIG. 14. Since the take-up reel 35 remains its current vertical position, the belts 4 and the touch rolls 5 are forced downward with an increase in diameter of the veneer roll 66. Therefore, the first arm 12 movable with the touch rolls 5 is swung clockwise as seen in FIG. 3 with the increase in the roll diameter, so that the load cell 20 is pushed and the piston rod 19*a* is moved gradually into the cylinder 19. Consequently, air within the cylinder 19 is compressed to increase the pressure therein. Accordingly, load detected by the load cell 20 is increased and eventually exceeds the set upward force.

If the load detected by the load cell 20 continues to be in excess of the set upward force by about 10 percent while the take-up reel 35 rotates a quarter of its complete turn, the control 60 generates a signal to the motor 41 to rotate the screws 38 in the direction that elevates the carriage 51 with the take-up reel 35 carried thereby. The take-up reel 35 thus elevated, the pressure acting on the touch rolls 5 from veneer roll 66 is decreased and the first arm 12 is allowed to swing back in counterclockwise direction. The force exerted by the second arm portion 18*a* to the load cell 20 is also decreased. Such elevation of the take-up reel 35 is stopped when the load detected by the load cell 20 becomes smaller than the set upward force of the cylinder 19 and also if this condition continues to be so while the take-up reel 35 makes a quarter turn.

As it is now apparent from the foregoing description, controllably elevating the take-up reel 35 in response to an increment in diameter of veneer roll 66 makes it possible to compensate for an increment of the veneer roll diameter, thus allowing the touch rolls 5 to be pressed against the veneer roll 66 with an optimum force of about 5 kilograms.

Figure 32:
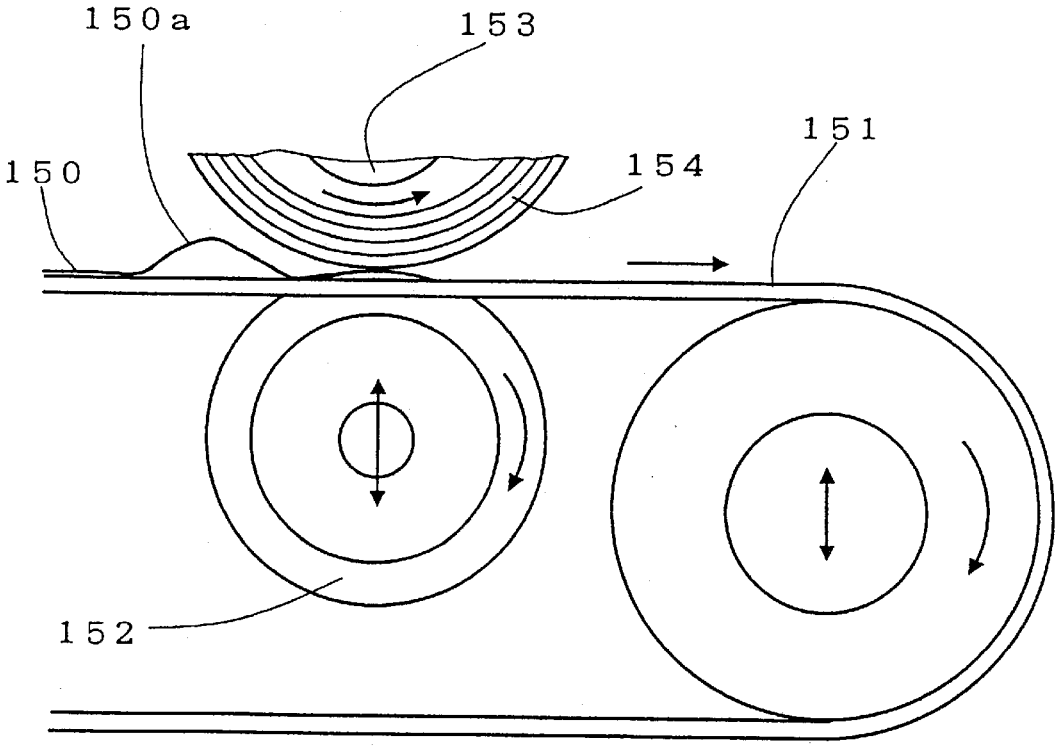
FIG. 32 PRIOR ART
FIG. 32 shows a prior art veneer reeling apparatus.

According the above embodiment, veneer reeling operation is performed with the touch rolls 5 kept in pressing contact with veneer roll 66, and an increasing diameter of the veneer roll 66 is monitored by the load cell 20 in terms of the force with which touch rolls 5 are pressed against: the veneer roll 66 for compensating for any increment in veneer roll diameter by elevating the take-up reel 35 in response to an increase of the above force above a predetermined level. Additionally, veneer roll 66 is positively driven to rotate by frictional force from the belts 4, so that the length of line-to-circle contact therebetween as measured in veneer conveying direction is longer than circle-to-circle contact in the case of the conventional apparatus of FIG. 28. Therefore, the magnitude of stress applied to a unit area of veneer sheet is advantageously reduced and harmful stressing of veneer sheet 65 as encountered in the conventional apparatus can be prevented. Consequently, the problems as described earlier with reference to FIG. 32, such as deviation from a straightforward course along the belts 4 which may result in collision against a frame, formation of folds in veneer sheet 65 causing breakage thereto can be solved.

Figure 15:
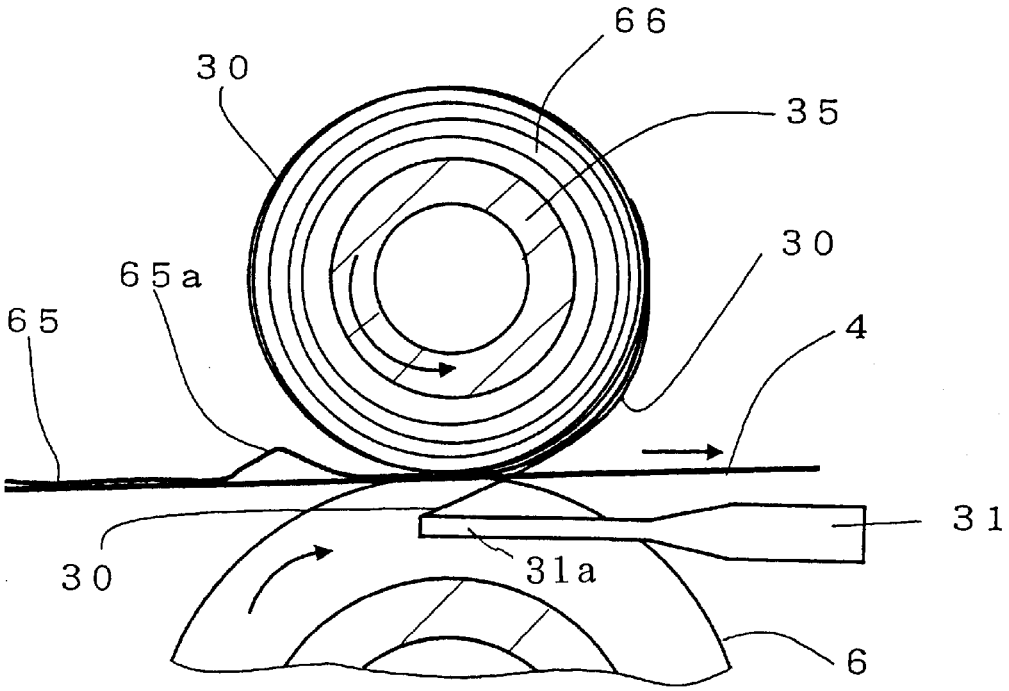

Depending on the kind or species of veneer to be reeled, however, a veneer sheet 65 may still be stretched and formed with slack 65*a* as shown in FIG. 15 behind the line of contact between the veneer roll 66 and the belts 4 in the region where the sheet is subjected to pressing force from the cylinders 26, e.g. of the first group, which are then supplied with the first pressure. Should the belt 4 of the first group continue to be pressed against the veneer roll 66, the slack may grow into a large wave, resulting in the formation of harmful folds which is wound as they are round the veneer roll 66.

According to the embodiment wherein pressure application to the cylinders 26 of the first and second groups is alternated by changing the air flow passages through the solenoid valves 81, 82 whenever the belts 4 have moved a predetermined distance of about 500 mm, however, the above veneer sheet 65 is subjected no more to stressing force in the region of the first group conveyer belts 4 when application of pressure to the first group cylinder 26 is changed to the second pressure and, therefore, the pressure acting on the first group belts 4 is reduced to such an extent that: only supports the plates 28 for the belts 4 so that the belt exert very little pressing force against the veneer roll 66. In such a case, the slack 65*a* passes between the veneer roll 66 and the touch rolls 5 without being accumulated into a large wave and the sheet is wound as slackened without being folded, as shown in FIG. 14. Since application of the second pressure takes place alternately to the cylinders 26 of the first and second groups, the above effect holds true if any slack 65*a* is formed in the region of veneer sheet 65 corresponding to the belts 4 of the second group.

If winding of veneer sheet 65 as slackened is continued in one end portion of veneer roll 66, e.g., corresponding to the belts 4 of the first group, the one end portion of veneer roll 66 becomes larger in diameter than the other end portion, so that the veneer roll 66 may result in a slightly tapered form. In such a case, the larger end of the taper forces down the touch rolls 5, which in turn causes the first arm 12 to swing in clockwise direction as seen in FIG. 3, with the result that the load cell 20 is pushed and the piston rod 19*a* is moved gradually into the cylinder 19. If the load applied to the load cell 20 is increased to exceed the set upward force by about 10 percent and such condition is continued while the take-up reel 35 makes a quarter turn, the control 60 generates a signal to the servo-motor 41 to elevate the reel carriages 51. This elevation is stopped when the load is reduced less than the set upward force and if such condition is continued while the take-up reel 35 makes a quarter turn. Such movement of carriages 51 to compensate for the tapered shape of veneer roll 66 is repeated until slack 65*a* is produced and wound no more and the roll 66 becomes substantially cylindrical. A veneer roll 66 thus formed has one end portion more loosely wound than the other end portion.

As will become apparent from comparison with some other embodiments of the present invention wherein alternate application of the first and second pressures from air cylinders acts on a front pulley or a similar member, the above first preferred embodiment is advantageous in that the air cylinders 26 only have to act on relatively lightweight belts 4 and, therefore, the belts 4 of the first and second groups can respond quickly to the alternate application of the first and second pressures and also that maintenance of the apparatus is easier.

In winding a thin and hence weak veneer sheet with a thickness of about 0.6 mm, portions of the sheet between any two adjacent conveyer belts 4 tends to sag by its own weight, but such portions are pressed against the veneer roll 66 with a moderate force by the touch rolls 5 clad with urethane rubber covering. Thus, smooth and stabilized reeling operation is accomplished in handling a thin veneer sheet.

A situation may be encountered where a debris, e.g. a piece of veneer produced by trimming with scarf knives provided on opposite sides of a veneer lathe (not shown), is present on a veneer sheet 65 and wound therewith round a veneer roll 66. The presence of such debris forces down the touch rolls 5 and causes the first arm 12 to swing, and the load cell 20 may be pressed to such an extent that a load detected by the load cell 20 exceeds the set upward force by about 10 percent. However, since the debris is usually a small piece which moves past the touch roll 5 rapidly before the take-up reel 35 makes a quarter turn, position of the reel 35 remains unchanged without being influenced by such debris.

Figure 18:
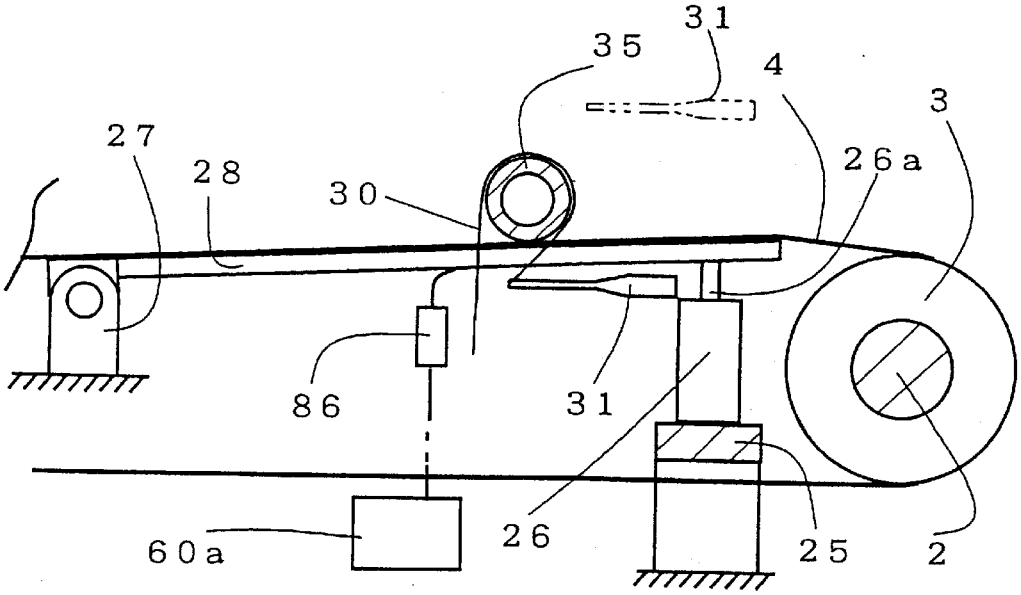
FIG. 18 is a fragmentary side view as seen in arrow direction from dash-and-dot line K—K of FIG. 17.

Instead of the load cell 20, one may contemplate the use of a limit switch, such as the one shown in FIG. 18, disposed so as detect the movement of the second arm 18 for monitoring an increase in diameter of a veneer roll 66. It is noted, however, that accurate setting of a limit switch 86 is extremely difficult in detecting a fine movement of the second arm 18. Unless the limit switch 86 is set very precisely, there is a fear that an excessive force may be applied to a veneer sheet 65 by veneer roll 66 before the limit switch 86 is actuated to generate a signal for raising the take-up reel 35 round which the veneer roll 66 is formed. Thus, the use of a limit switch 86 is disadvantageous in handling a thin or weak veneer sheet which may be broken easily by the above excessive force. On the other hand, the load cell 20 which monitors an increase in veneer roll diameter by detecting the force that the veneer roll 66 applies to the touch rolls 5 may be set advantageously to generate the signal before a harmful force acts on veneer sheet 65.

Figure 16:
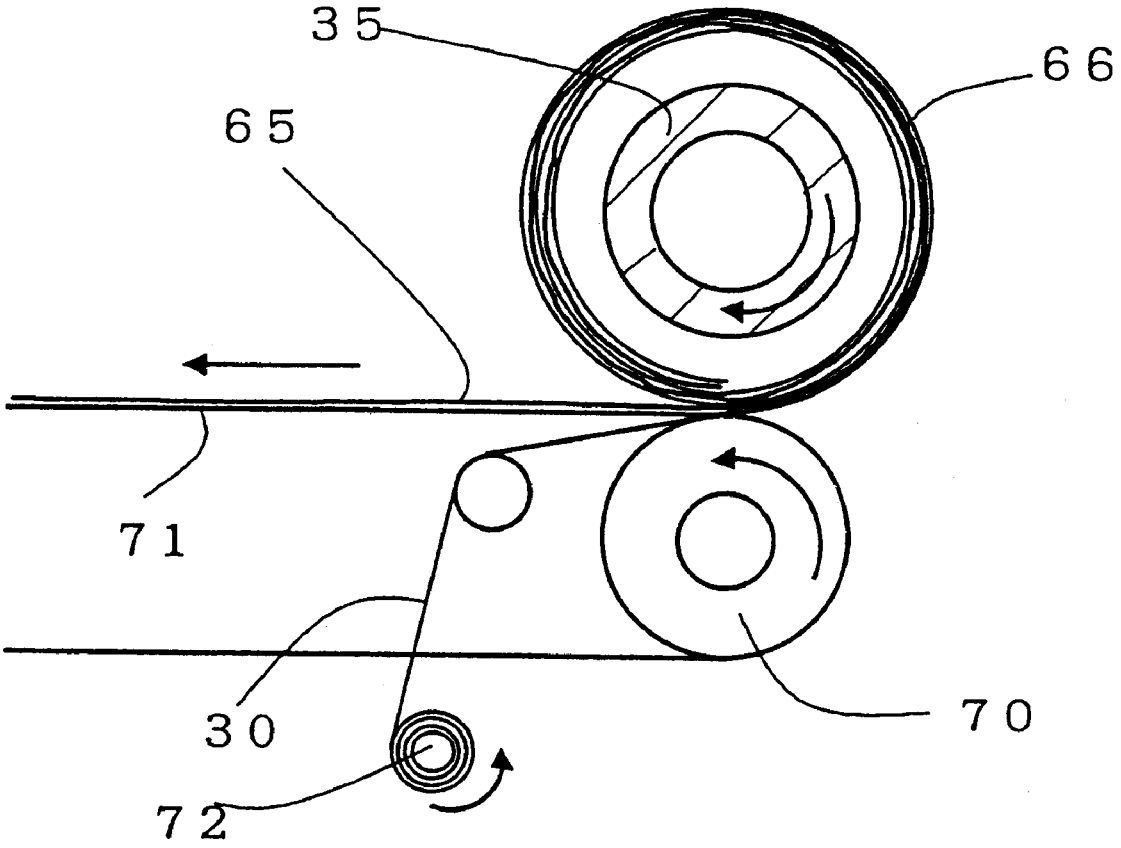
FIG. 16 is a fragmentary side illustrative view showing a process of unwinding veneer sheet from take-up reel.

Reeling operation is continued until the veneer roll 66 reaches a predetermined diameter. When the reeling has been completed, the take-up reel 35 with veneer roll 66 is removed from the carriages 51 and transferred to any station for the subsequent unreeling process. A manner of unreeling is exemplified in FIG. 16. The take-up reel 35 is rotatably supported by a pair of carriages (not shown) similar to the carriages 51 having a V-shaped groove, and a plurality of belts 71 driven by a pulley 70 in arrow direction is pressed against the peripheral surface of veneer roll 66 with an appropriate pressure by any suitable means (not shown). By so doing, veneer roll 66 is rotated in unwinding direction as indicated by arrow. While veneer sheet 65 is being unreeled from roll 66, the threads 30 are unwound synchronously with the traveling speed of the belts 71 to be rewound on bobbins 72 each located below a space between any two adjacent belts.

Figure 17:
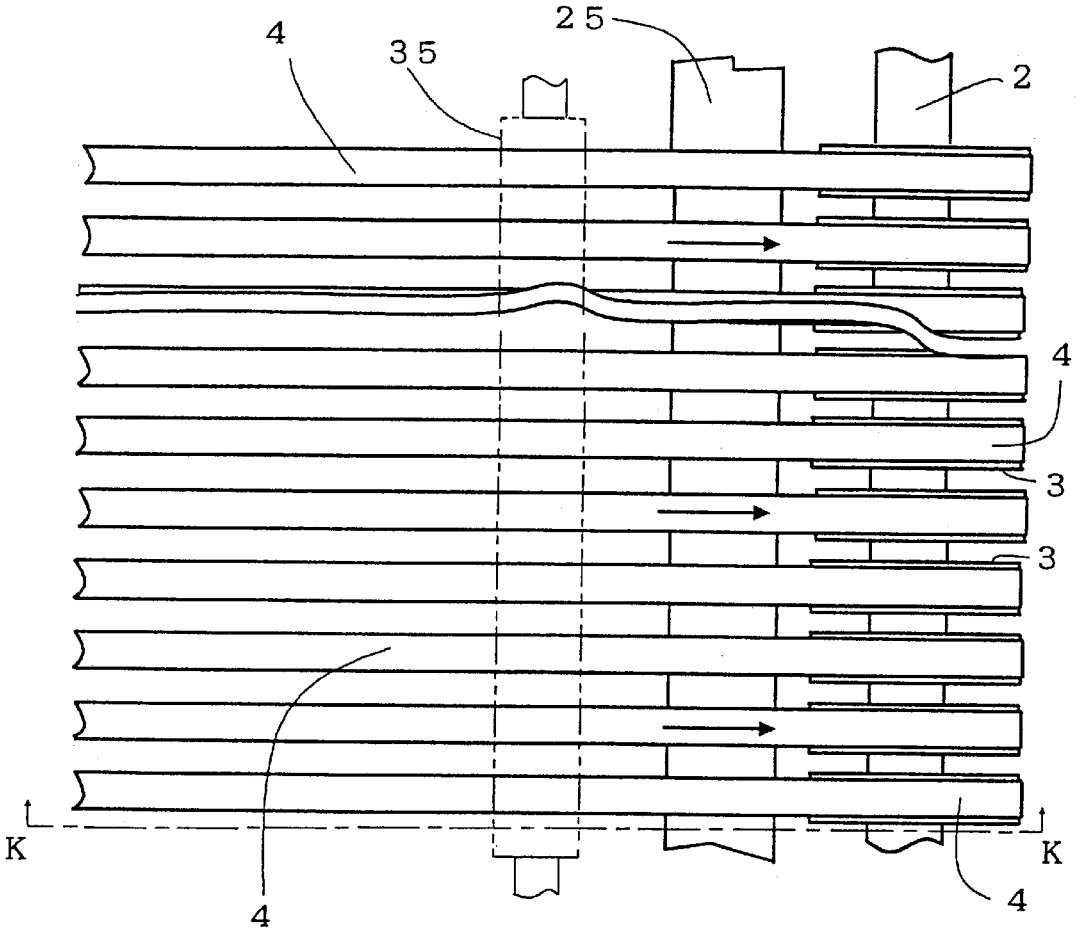
FIG. 17 is a fragmentary plan view of second embodiment of veneer reeling apparatus according to the present invention.

Referring to FIGS. 17 and 18, the following will describe a second embodiment of veneer reeling apparatus according to the invention, wherein elements corresponding to elements of the first embodiment are designated by like reference numerals. The second embodiment differs from the first embodiment mainly in that it dispenses with the touch roll assembly 6 and its associated parts such as first and second arms 12, 18, load cell 20 and cylinder 19.

Referring to FIG. 17, the apparatus comprises a plurality of conveyer belts 4 which are similar to, but more in number than those in the first embodiment and spaced at smaller intervals. In this embodiment, there is provided an array of a total of 16 conveyer belts 4 which are arranged into first and second groups, namely, eight belts located on the left-hand side as seen in veneer conveying direction which will be referred to as belts of a first group, while the remaining eight belts on the right-hand side as belts of a second group. Each belt 4 is trained round a front pulley 3 mounted on a common drive shaft 2 and driven by a motor (not shown). As seen in FIG. 18 which shows the initial state condition of the apparatus of the second embodiment, there is provided a support base 25 extending behind the pulley 3 and straddling the lower legs of the conveyer belts 4. On the support base 25 are fixed an air cylinder 26 corresponding to each belt 4. Each belt 4 has on its inner surface a backup plate 28 having substantially the same width as the belt 4 and rotatably supported at the upstream end thereof by a bearing 27.

The apparatus has a pneumatic system similar to that shown in FIG. 5 and described with reference to the first embodiment. In the illustrated embodiment, the first pressure adjusted by the reducing valves 77, 79 is of such a magnitude that, when introduced into each cylinder 26 for the belt 4 of either one of the groups, allows each such belt 4 to exert a pressing force of about 2.5 kilograms against the take-up reel 35 or veneer roll 66, namely 20 kilograms by eight belts 4 of the above one group. On the other hand, the second pressure from the reducing valves 78, 80 is of such a magnitude that only supports the plate 28 for each belt 4 and allows each belt 4 to exert very little pressing force against the take-up reel 35 or veneer roll 66.

A pair of limit switches 86 is fixedly mounted on a frame (not shown) at an appropriate position where they can be stricken or turned on by plates 28 for the belts 4 located at the extreme opposite sides of the array of the belts 4 when the plates 28 are moved down together with the belts 4 to a predetermined position. As indicated by phantom line in FIG. 18, the limit switches 86 are electrically connected to a control 60*a* to generate thereto a signal when either one of the limit switches 86 is turned on. Additionally, a plurality of thread nozzles 31 is disposed adjacent the take-up reel 35 between any two selected adjacent belts 4 for feeding therefrom a thread 30 as in the first embodiment.

Other devices and elements such as mechanism for controllably moving the take-up reel carriages 51 are constructed substantially the same.

The control 60*a* is operable on the motor 41 (FIG. 1), the motor for driving the shaft 2 and the solenoid-operated valves 81, 82 in accordance with output signal from rotary encoders 42, 43 and limit switches 86, as well as manually generated signals, as follows.

When at least one of the limit switches 86 is turned on by plate 28 lowering together with its belt 4 while the carriages 51 are moving downward and the pulley drive shaft 2 kept at a stop, which stop condition is detected by the rotary encoder 43, the control 60*a* then responding to a signal from the actuated limit switch 83 generates a command signal to stop the motor 41 and then to operate the motor so as to rotate the screws 38 in the direction that elevates the take-up reel carriages 51 until the limit switch 86 generates the signal no more. On the other hand, when at least one of the limit switches 86 is actuated while the pulley drive shaft 2 is being rotated and also if the actuated limit switch 86 remains on while the take-up reel 35 makes a quarter turn, the control 60*a* generates a signal commanding the motor 41 to operate to rotate the screws 38 in the direction that causes the carriages 51 to be elevated. This elevation is continued until both limit switches 86 are turned off and also if this condition continues while the take-up reel 35 makes a quarter turn.

While the pulley drive shaft 2 is running, the control 60*a* calculates traveling distance of the belts 4 in accordance with information of traveling speed of the belts obtainable from the rotary encoder 43 and of time elapsed. As in the first embodiment, each time when the belts 4 have moved a predetermined distance, e.g. 500 mm, the control 60*a* provides a signal to the solenoid-operated valves 81, 82 to change the air flow passages so that the first pressure is supplied to the cylinders 26 of one of the first and second groups while the second pressure is supplied to the cylinders 26 of the other group of the first and second groups. Such operation of the solenoid valves 81, 82 is alternated repeatedly whenever the belts 4 move the above distance of 500 mm.

The apparatus of the second embodiment is set in its initial state as follows.

In accordance with manual operation on a control panel by machine operator, the control 60*a* generates a signal to operate the solenoid valves 81, 82 to establish air flow passages for applying the first pressure to the air cylinders 26 of the first groups and the second pressure to the air cylinders 26 of the second group, respectively. Then, the servo-motor 41 is operated from a manual signal to rotate the screws 38 in the direction causing the reel carriages 51 to be lowered to a position higher than that shown in FIG. 1 in the first embodiment. After the take-up reel 35 is set in position on the carriages 51, the motor 41 is manually operated to rotate the screws 38 in the direction to lower the carriages 51 with the take-up reel 35. By so doing, the take-up reel 35 is brought into pressing contact with the conveyer belts 4 and the plates 28 are swung down while forcing the piston rod 26*a* into the cylinder 26. By allowing the take-up reel 35 to move further downward, at least one of the limit switches 86 is turned on. Accordingly, the control 60*a* generates a signal commanding the motor 41 to stop and then to operate to rotate the screws 38 in the direction that causes the take-up reel carriages 51 to be raised. As described earlier, when the limit switch 86 is turned off, the motor 41 is stopped and the upward movement of the reel carriages 51 is also stopped. As a result of the above manual operation, the take-up reel 35 is set in its initial state position as shown in FIG. 18.

In this initial state condition, the piston rod 26*a* is extended partially out of its cylinder 26 and engaged in pressing contact with its associated plate 28 so that, when the take-up reel 35 is moved slightly upward, the piston rod 26*a* can extend further to keep contact engagement with the plate 28, thereby keeping the belts 4 to be in pressing contact with the take-up reel 35 or veneer roll 66.

Veneer reeling operation is initiated with the nozzles 31 previously shifted to the position as indicated by solid line in FIG. 18, the threads 30 located over the take-up reel 35 and resistance applied to the thread 30 so that it will be pulled out taut during reeling operation. Then, the belts 4 are driven in forward direction by manually activating the motor for pulley drive shaft 2. Simultaneously, the take-up reel 35 is frictionally driven by the belts 4 and the control 60*a* starts to calculate the traveling distance of the belts for actuating the solenoid valves 81, 82 to alternately change the air flow passages therethrough. A veneer sheet 65 transferred by the belts 4 is guided along the reel periphery by threads 30 and wound with the thread 30 round the reel 35.

As the reeling operation is continued and a veneer roll 66 increases its diameter, the belts 4 and the plates 28 are forced down until at least one of the limit switches 86 is stricken by its associated plate 28 to be turned on. If that limit switch 86 remains on while the take-up reel 35 rotates a quarter of its complete turn, the control 60*a* generates a signal to the motor 41, which in turn rotates the screws 38 in the direction that causes the carriages 51 to be elevated with the take-up reel 35. The elevation of the carriages 51 is continued until the limit switch 86 is turned off and also if this off condition remains while the take-up reel 35 makes a quarter turn. Thus, the take-up reel 35 is controllably elevated in response to an increasing diameter of the veneer roll 66, thus compensating for an increment of the veneer roll diameter to allow the touch rolls 5 to be pressed against the veneer roll 66 with an optimum force.

As in the first embodiment, if any slack 65*a* is formed in the veneer sheet 65 during reeling operation in the region of the belts 4 of either one of the first and second groups, the slack 65*a* passes between the veneer roll 66 and the touch rolls 5 without being accumulated into a large wave when pressure application to the cylinders 26 is changed after the belts 4 have moved a distance of 500 mm, and the sheet 65 is wound loosely as slackened safely.

If the veneer sheet 65 is wound loosely and one end portion of veneer roll 66 becomes larger in diameter than the other end portion, the former end portion forces down the belts 4, which in turn causes at least one of the limit switches 86 to be turned on. If this condition is continued while the take-up reel 35 makes a quarter turn, the control 60*a* generates a signal to the servo-motor 41 to elevate the reel carriages 51. This elevation is stopped when the limit switch 86 is turned off and if such condition is continued while the take-up reel 35 makes a quarter turn. Such movement of carriages 51 to compensate for the tapered shape of veneer roll 66 is repeated until slack 65*a* is produced and wound no more and the roll 66 becomes substantially cylindrical. As in the first embodiment, a veneer roll 66 thus formed has one end portion loosely wound than the other end portion.

Figure 19:
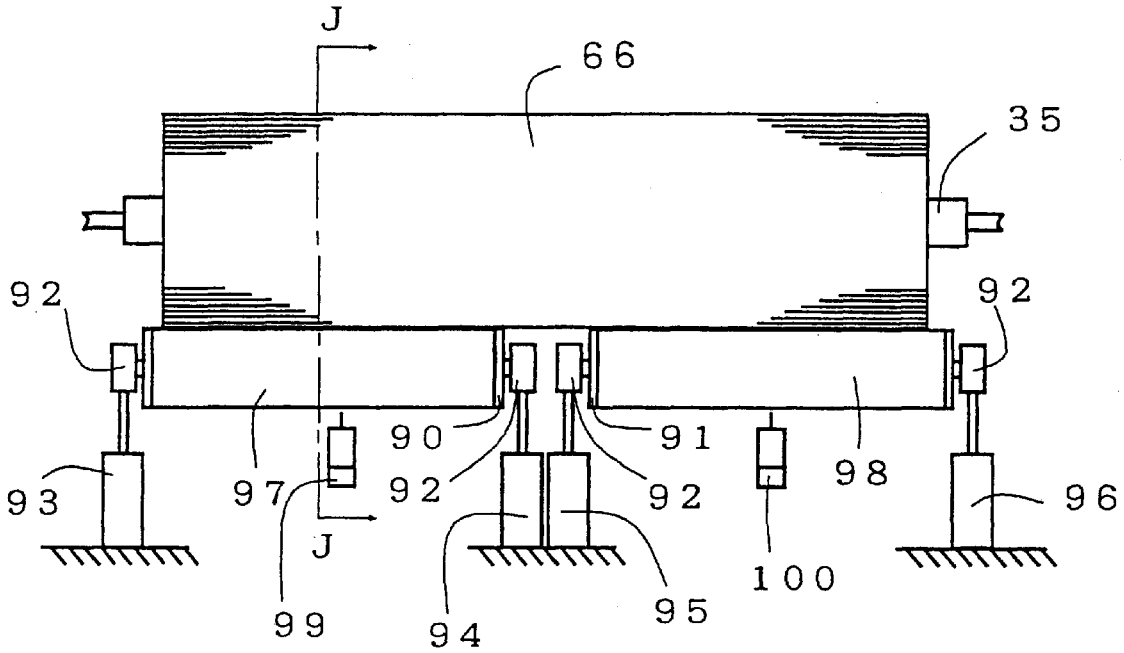
FIG. 19 is a schematic front view of third embodiment of veneer reeling apparatus according to the invention.
Figure 20:
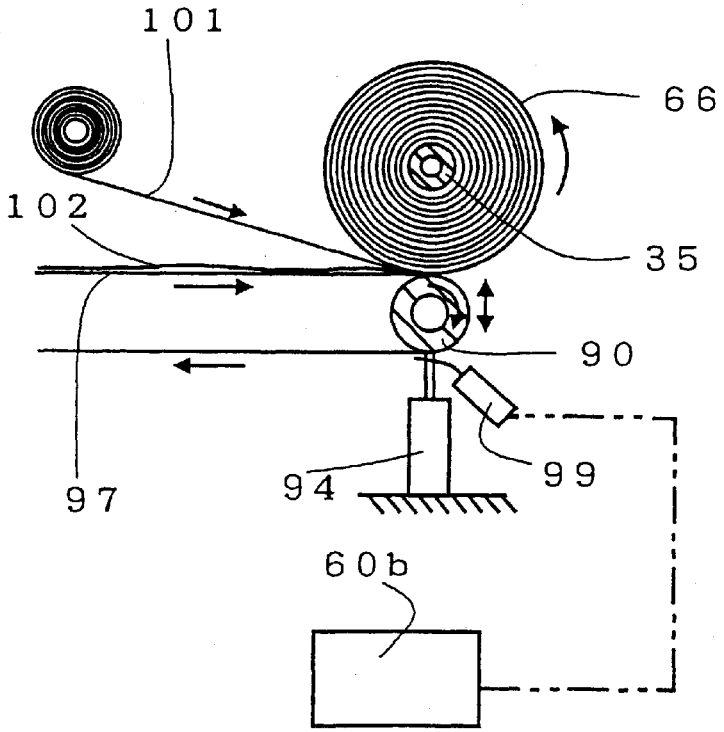
FIG. 20 is a side view as seen in arrow direction from dash-and-dot line J—J FIG. 19.
Figure 21:
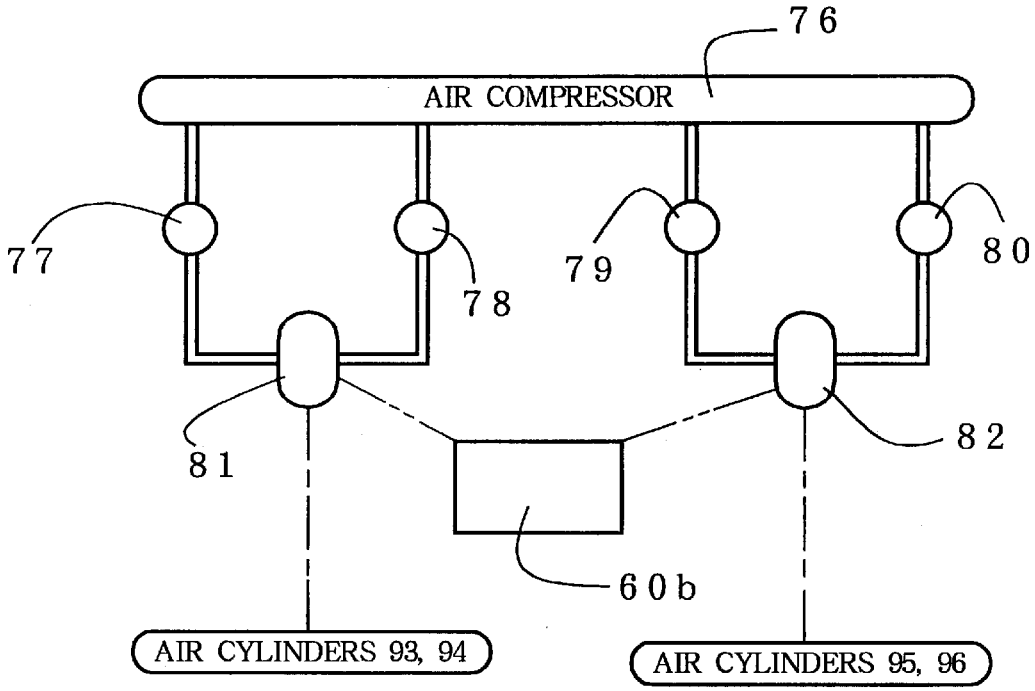
FIG. 21 is a schematic diagram showing a pneumatic system of the veneer reeling apparatus of FIGS. 19 and 20.

Referring now to FIGS. 19, 20 and 21, showing a third embodiment of the invention, this differs from the above embodiments in that plates 28 are dispensed with and the belts are pressed against veneer roll by cylinders by way of a pulley.

The apparatus of the third embodiment comprises two endless conveyer belts, namely first and second belts 97, 98 trained round first and second pulleys 90, 91, respectively, and a take-up reel 35 dispose above the pulleys. The belts 97, 98 are driven to travel as indicated by arrows (FIG. 20) by a common rear pulley (not shown) round which the belts are trained and which is connected to a drive motor (not shown either). The pulleys 90, 91 are freely rotatably supported at their opposite ends by bearings 92 which are movable along guides (not shown). First and second pairs of air cylinders 93. 94 and 95, 96 are provided having their piston rods placed in pressing contact with the bearings 92 for the first and second pulleys 90, 91, as shown in FIG. 19.

As shown in FIG. 21, the first and second pairs of air cylinders 93, 94 and 95, 96 are fluidly connected to solenoid-operated valves 81, 82, respectively, which are in turn connected to reducing valves 77, 78 and 79, 80, respectively, for adjusting the pressure of air from air compressor 76 to a first pressure and to a second pressure, respectively in the same manner as in the pneumatic system described with reference to FIG. 5 for the first and second embodiments. The first pressure adjusted by the reducing valves 77, 79 is of such a magnitude that, when introduced into the air cylinders of either of the pairs 93, 94 and 95, 96, allows the associated pulley 90 or 91 to exert by way of the belt 97 or 98 a pressing force of about 20 kilograms against the take-up reel 35 or veneer roll 66. On the other hand, the second pressure from the reducing valves 78, 80 is of such a magnitude that only supports the pulley 90 or 91 and allows the associated belt 97 or 98 to exert very little pressing force against the take-up reel 35 or veneer roll 66. The above solenoid-operated valves 81, 82 are electrically connected to a control 60*b* to receive therefrom a command signal.

The control 60*b* of this third embodiment is operable on the solenoid valves 81, 82 to establish such air flow passages that the inlet ports of the air cylinders 93, 94, 95, 96 are closed and the outlets ports thereof are opened so that no pressure is produced by the cylinders and, therefore, no pressure is applied to the belts 97, 98 via the pulleys 90, 91.

Limit switches 99, 100 are located below the pulleys 90, 91, respectively, to be actuated when the pulleys are moved down to a predetermined position. Reference numeral 101 designates a gum tape which is unwound from a reel and fed between a veneer sheet 102 and a veneer roll 66 and has an upper face which becomes adhesive when applied with moisture.

Though not shown in FIGS. 19 and 20, the veneer reeling apparatus of the third embodiment further includes a rotary encoder 43 for monitoring the traveling speed of the conveyer belts 97, 98 and mechanism for controllably moving the take-up reel 35 as shown in FIGS. 1, 6 and 7.

The control 60*b* is operable on the motor 41, a motor for driving the rear pulley and the solenoid valves 131, 82 in accordance with output signal from rotary encoders 43 and limit switches 99, 100, as well as manually generated signals, as follows.

When at least one of the limit switches 99, 100 is turned on by the belt 97 or 98 lowering with the front pulley 90 or 91 while the carriages 51 are moving downward and the belts 97, 98 kept at a stop, the control 60*a* then responding to a signal from the actuated limit switch 99, 100 generates a command signal to stop the motor 41 and then to operate the motor so as to rotate the screws 38 in the direction that elevates the take-up reel carriages 51 until the above limit switch 99, 100 generates the signal no more. On the other hand, when at least one of the limit switches 99, 100 is actuated while the belt drive pulleys 90, 91 are being rotated and also if the actuated limit switch 99, 100 remains on while the take-up reel 35 makes a quarter turn, the control 60*b* generates a signal commanding the motor 41 to operate to rotate the screws 38 in the direction that causes the carriages 51 to be elevated. This elevation is continued until both limit switches 99, 100, are turned off and also if this condition remains while the take-up reel 35 makes a quarter turn.

While the belts 97, 98 are running, the control 60*b* calculates traveling distance of the belts in accordance with information of traveling speed of the belts obtainable from the rotary encoder 43 and of time elapsed. As in the first embodiment, each time when the belts 97, 98 have moved a predetermined distance, e.g. 500 mm, the control 60*b* provides a signal to the solenoid-operated valves 81, 82 to change the air flow passages so that the first pressure is supplied to the cylinders 93, 94 or 95, 96 of one of the first and second groups while the second pressure is supplied to the cylinders 93, 94 or 95, 96 of the other group of the first and second groups. Such operation of the solenoid valves 81, 82 is alternated repeatedly whenever the belts 97, 98 move the above distance of 500 mm.

To set the apparatus of the third embodiment in its initial state, firstly the control 60*a* is manually operated to generate a signal to actuate the solenoid valves 81, 82 to establish air flow passages for applying the first pressure to the air cylinders 93, 94 of the first groups and the second pressure to the air cylinders 95, 96 of the second group, respectively. With the take-up reel 35 installed in position on the carriages 51, the motor 41 is manually operated to rotate the screws 38 in the direction to lower the carriages 51 with the take-up reel 35. By so doing, the take-up reel 35 is moved into pressing contact with the conveyer belts 97, 98 to force the pulley 90 downward until both limit switches 99, 100 are turned on. The control 60*b* responding to a signal representative of such condition of the limit switches 99, 100 generates a signal commanding the motor 41 to stop and then to operate to rotate the screws 38 in the direction that causes the take-up reel carriages 51 to be raised. When the limit switches 99, 100 are both turned off, the motor 41 is stopped and the upward movement of the reel carriages 51 is also stopped. Thus, the apparatus of this third embodiment is set in its initial state position where the pulley 90 is pressed against the take-up reel 35 via the belt 97, while the pulley 91 is placed so as to support the reel by way of the belt 98.

In operation, the belts 97, 98 are activated by starting the rear pulley drive motor (not shown) from a manual signal. A veneer sheet 102 peeled by a veneer lathe at a speed corresponding to the traveling speed of the belts 97, 98 is guided over the belts 97, 98. After the leading end of the veneer sheet 102 has passed between the take-up reel 35 and the belts 97, 98, the above rear pulley drive motor and the veneer lathe are stopped. Then, each of the air cylinders 93, 94, 95, 96 is operated to close its inlet port and open its outlet port so that no pressure is present in the cylinder and the pulleys 97, 98 are moved downward with the belts 90, 91 by their own weight to provide an access clearance between the take-up reel 35 and the belts 90, 91. A workman manually guides the leading end of the veneer sheet 102 and winds the veneer sheet 102 round the take-up reel 35 for a couple of turns by rotating the reel 35 by hand in counterclockwise direction as seen in FIG. 20. The workman then guides the leading end portion of gum tape 101 onto the veneer sheet 102 wound round the take-up reel 35 so that its adhesive face is attached to the veneer sheet 102.

The machine operator provides a signal to the solenoid valves 81, 82 to supply the first pressure to the air cylinders 93, 94 and the second pressure to the air cylinders 95, 96, elevating the pulleys 90, 91 and hence the belts 97, 98 into pressing or supportive contact with veneer sheet 102 wound round the take-up reel 35. Restarting the peeling operation and the belts 97, 98, veneer sheet 102 coming from the veneer lathe is wound round the take-up reel 35 with the gum tape 101 adhered to the underside of the veneer sheet 102 into a veneer roll with a progressively increasing diameter.

With an increase in diameter of the veneer roll 66, the pulleys 90, 91 are forced down until at least one of the limit switches 99, 100 is stricken by its associated belt 97 or 98. If that limit switch 99, 100 remains on while the take-up reel 35 makes a quarter turn, the control 60*b* generates a signal to the motor 41, rotating the screws 38 in the direction that causes the carriages 51 to be elevated with the take-up reel 35. The elevation of the carriages 51 is continued until the limit switch 99, 100 is turned off and also if this off condition remains while the take-up reel 35 makes a quarter turn. Thus, the take-up reel 35 is controllably elevated in response to an increasing diameter of the veneer roll 66, thus compensating for an increment of the veneer roll 66 diameter.

As mentioned earlier, as the belts 97, 98 starts its traveling movement, the control 60*b* calculates traveling distance of the belts 97, 98 to generate a signal to the solenoid-operated valves 81, 82 to change application of the first and second pressures to the cylinders 93, 94 and 95, 96 whenever the belts 97, 98 have moved a predetermined distance of 500 mm. Such operation of the solenoid valves 81, 82 is alternated repeatedly whenever the belts 97, 98 move the above distance of 500 mm.

Reeling operation is continued until the veneer roll 66 reaches a predetermined diameter. When the reeling has been completed, the take-up reel 35 with veneer roll 66 is removed from the carriages 51. In the case of this third embodiment, unreeling operation is performed without withdrawing and collecting the gum tape.

The following will further describe other various embodiments and modifications which fall within the scope of the present invention, wherein elements corresponding to elements of the above embodiments are designated by like reference numerals.

Figure 22:
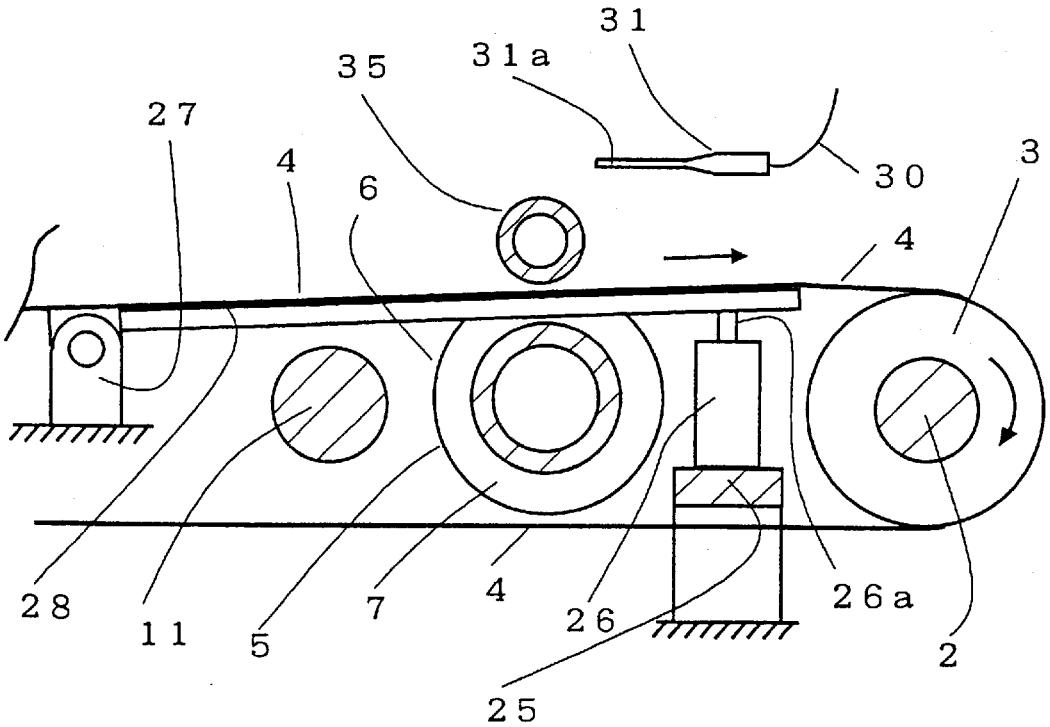
FIG. 22 is a fragmentary schematic side view of a modified embodiment of veneer reeling apparatus of the present invention.

In the above embodiments, the belts of one group under the second pressure are brought into contact engagement with the veneer roll 66. According to the invention, however, the belts do not necessarily have to contact with the veneer roll 66. As exemplified in FIG. 22 showing a modification of the first embodiment, a clearance may be formed between the belt 4 and the take-up reel 35 under the second pressure by supplying no compressed air into the air cylinder 26 of one of the first and second groups. That is, the second pressure may be of a zero pressure.

Figure 23:
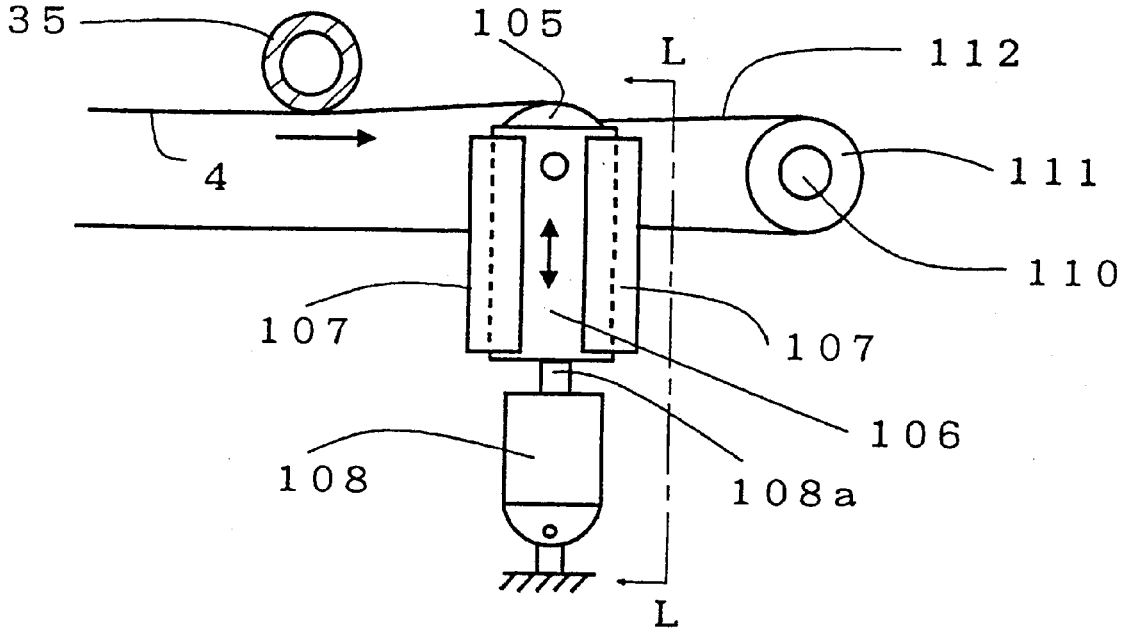
FIG. 23 is a fragmentary schematic side view of another embodiment of veneer reeling apparatus of the invention.
Figure 24:
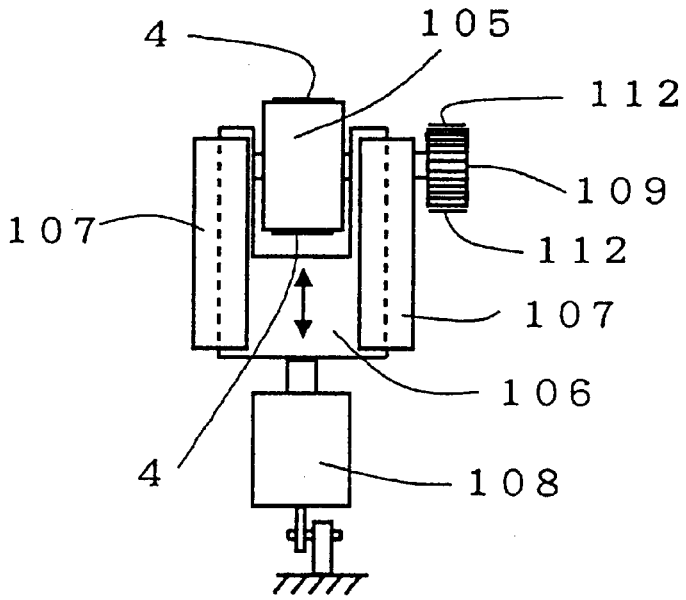
FIG. 24 is a front view as seen in arrow direction from dash-and-dot line L—L of FIG. 23.

Reference is made to FIGS. 23 and 24 showing an embodiment in which the plate 28 of the first and second embodiment is dispensed with, a pulley 105 round which each belt 4 is trained is acted upon by an air cylinder 108 and the take-up reel 35 is disposed on the upper legs of the belts 4. In this embodiment, two groups of pulleys 105, which are fixedly mounted on a common pulley shaft and round which conveyer belts 4 are trained, are rotatably supported by bearings (not shown) in the respective pulley support blocks 106. Each support block 106 is in turn vertically movably guided by a guide member 107 fixed to a frame (not shown). Disposed below the pulley support block 106 is an air cylinder 108 having a piston rod 108*a* extended into contact engagement with the support block 106. As shown in FIG. 24, a gear 109 is fixed on the pulley shaft and operatively connected by a cogged belt 112 with another gear 111 fixed on a shaft 110 driven by a common stationary motor (not shown). Thus, the pulleys 105 are allowed to move vertically along the guide member 107 while being driven from the motor. As apparent from FIG. 23, the take-up reel 35 or veneer roll 66 is rotatable by friction from the belts 4 driven by the pulleys 105. In this embodiment, the first and second pressures are alternately supplied to the air cylinders 108 for the pulleys 105 of the first and second groups in the same manner as in the preceding embodiments. Air pressure in the cylinders 108 for alternately changeable first and second pressures may be set to provide the same effect as in the preceding embodiments. To detect the displacement of the belt 4 caused by an increase in diameter of veneer roll 66, a limit switch may be used which is actuated by contact with the belt 4.

Figure 25:
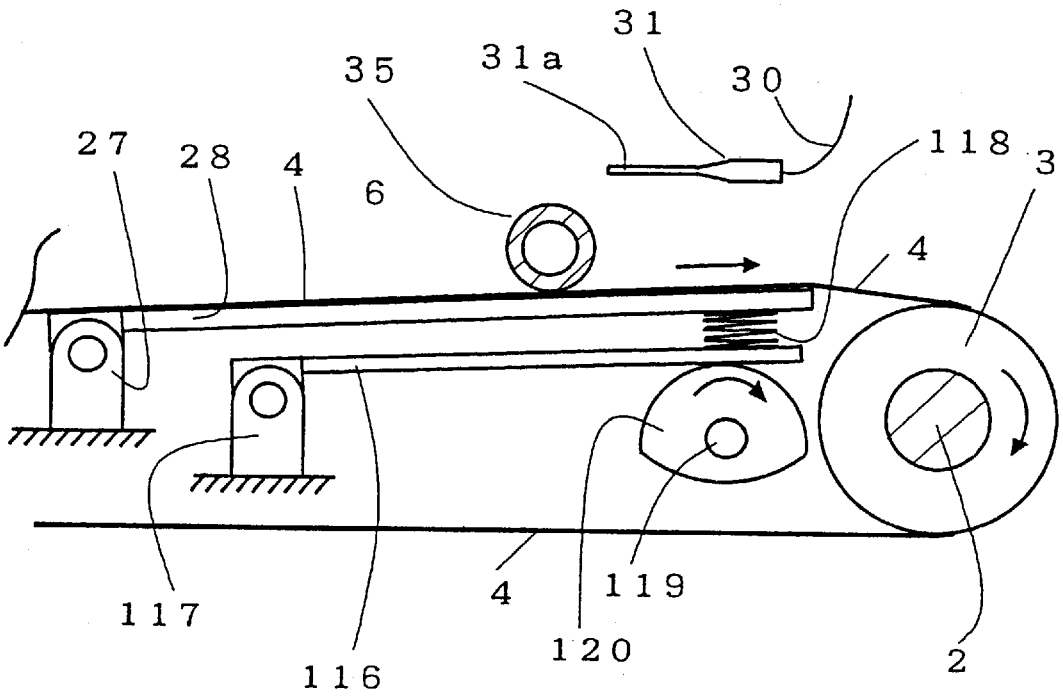
FIGS. 25 and 26 are schematic side views of a further embodiment of veneer reeling apparatus of the invention, showing two different conditions of the apparatus.
Figure 26:
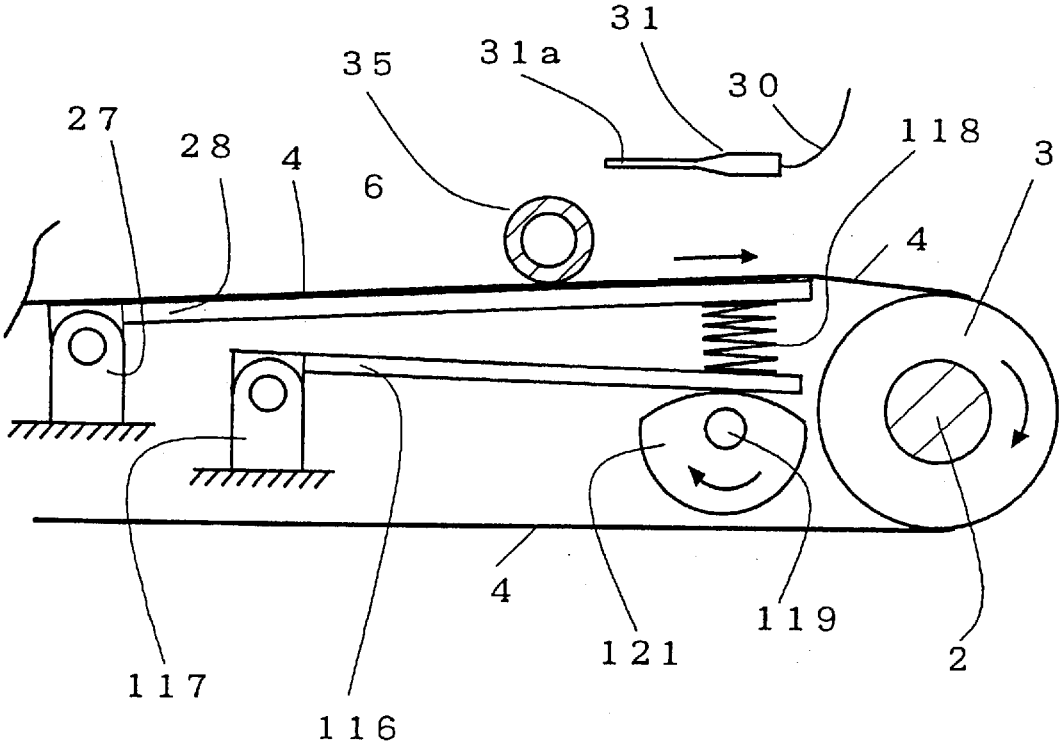

Referring to FIGS. 25 and 26, these illustrate an embodiment wherein the air cylinder 26 of the second embodiment as means for pressing the belt 4 against the take-up reel 35 or veneer roll is replaced by cam and compression spring. In the drawings, reference numeral 116 designates a second swingable plate located just below each first plate 28 and swingably supported by a bearing 117. A compression spring 118 is fixedly mounted between the distal end portions of the two plates 28 and 116. A shaft 119 extends below the second plate 116 where the spring 118 is fixed. The shaft 119 is rotatably supported by stationary bearings (not shown) and driven by a servo-motor (not: shown either). In this embodiment, there is provided a total of 16 conveyer belts 4 which are arranged into first and second groups as in the second embodiment. A cam 120 as shown in FIG. 25 is fixedly mounted on the shaft 119 for rotation therewith for each belt 4 of the first group and a cam 121 is fixed on the same shaft 119 for each belt 4 of the second group. As seen from comparison of FIGS. 25 and 26, the cams 120 and 121 have the same profile, but are disposed in symmetrical arrangement such that one of the cams 120 and 121 is in a position rotated by a half turn from that of the other cam. In the position of the apparatus shown in FIGS. 25 and 26, the second plate 116 is raised by the cam 120 while compressing the spring 118 thereby to urge the first plate 28 upward, so that belt 4 of the first group is pressed against the take-up reel 35 with a relatively large force, while the second plate 116 of the second group is in its lowered position with the spring 118 less compressed so that belt 4 of the second group is pressed against the reel 35 with a relatively small force. The magnitude of forces applied to the take-up reel 35 in the above two positions of the cams 120 and 121 may be determined by selecting springs with the desired spring constant. There is provided a control (not shown) which is operable to generate a signal commanding a motor (not shown) to rotate the shaft 119 a half turn whenever the belts 4 has moved a predetermined distance, e.g., about 500 mm. Thus, the conveyer belts 4 of the first and second groups press the take-up reel 35 with a large force and a small force alternately each time the belts move the above distance. Thus, the apparatus of this embodiment provides an effect similar to that obtained in the second embodiment.

Figure 27:
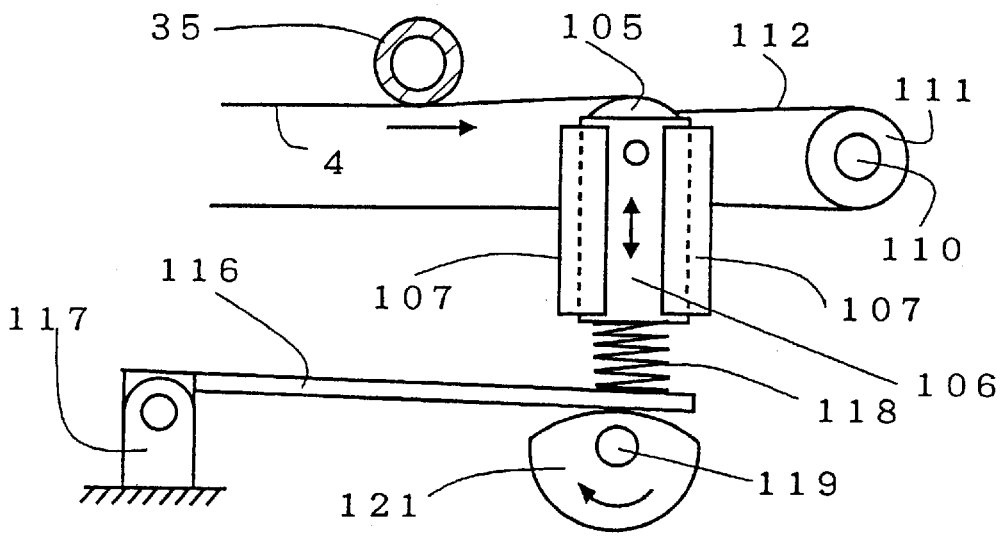
FIG. 27 is a fragmentary schematic side view showing still another embodiment of veneer reeling apparatus of the invention.

Referring to FIG. 27, this shows an embodiment combining the features of the embodiments of FIGS. 23, 24 and of FIGS. 25, 26. Namely, the air cylinder 108 (FIGS. 23, 24) is replaced by a swingable plate 116 supported by bearing 117, a compression spring 118 and a cam 120 or 121 fixedly mounted on a shaft 119 driven by motor (not shown) as illustrated in FIGS. 25 and 26. The conveyer belts 4 includes first and second groups of such belts which are pressed against the take-up reel 35 with large and small forces alternately.

Figure 28:
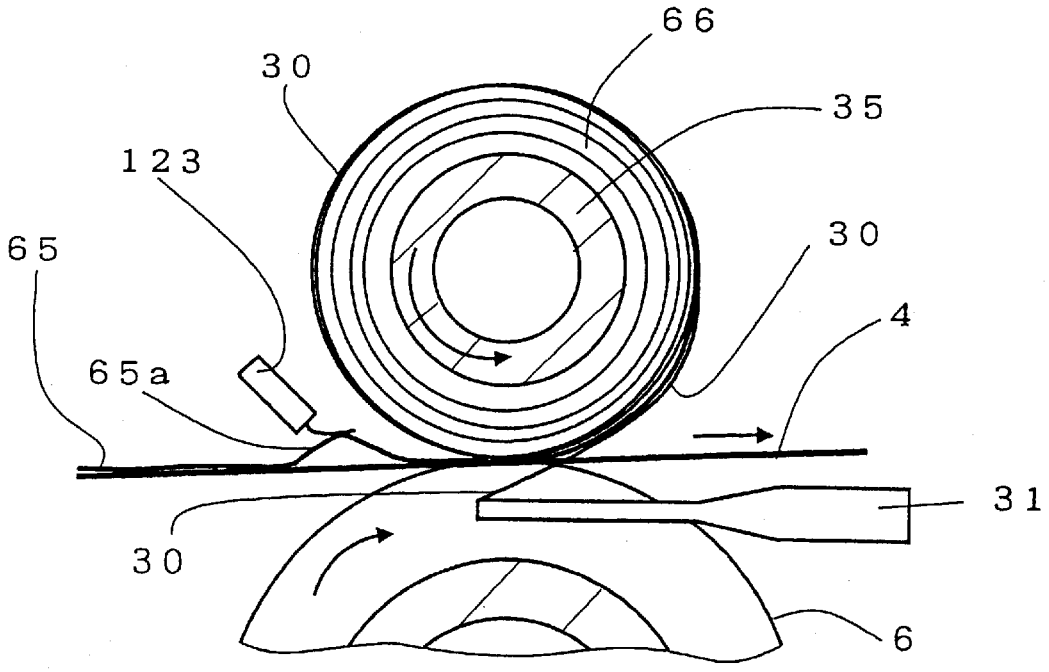
FIG. 28 is a side view showing still another embodiment of veneer reeling apparatus of the invention.

Referring to FIG. 28 showing a limit switch 123 arranged to detect the presence of a raised portion or slack 65*a* formed in a veneer sheet 65 during reeling operation, this drawing illustrates a modification of the invention wherein all the belts 4 are normally pressed against the veneer roll 66 with a force corresponding to the first pressure as described in the preceding embodiments, but the pressing force for only those belts 4 which are adjacent any slack 65*a* formed in the veneer sheet 65 is reduced to permit the veneer sheet to be wound as slackened. For the sake of description, the embodiment of FIG. 28 will be described as a modification of the first embodiment. In view of the fact that slack 65*a* tends to be formed immediately behind the line of contact between the belts 4 and veneer roll 66, as shown in FIG. 28, and in the region of veneer sheet 65 adjacent the lateral sides thereof, a pair of limit switches 123 is provided above the veneer sheet 65, one adjacent each lateral side of the veneer sheet 65 for detecting the presence of any slack 65*a*. During normal reeling operation, all the air cylinders 26 for the first and second groups of belts 4 are charged with the first pressure so that each belt 4 is resiliently pressed against the veneer roll 66 with a predetermined force. If the veneer sheet 65 is formed with slack 65*a*, for example, in the region of the first group of belts 4, the limit switch 123 adjacent the first group belts is actuated by the slack 65*a* as illustrated in FIG. 28 thereby to generate a detection signal to the control 60. The control 60 receiving the signal from the limit switch 123 provides a command signal to reduce the pressure of the air cylinders 26 for the first group to the second pressure. Therefore, the slack 65*a* passes easily between the veneer roll 66 and the belts 4 without being accumulated into a large wave and the sheet is wound as slackened. If the slack 65*a* disappears, the limit switch 123 is turned off and the control 60 provides a signal to change the second pressure of the air cylinders 26 of the first group to the first pressure. The same is true when the veneer sheet 65 is formed with slack 65*a* in the opposite side of the veneer sheet 65. Such modified embodiment is useful in reeling a veneer sheet 65 that is less susceptible to the formation of slack 65*a* because of its thickness or species. Furthermore, the control 60 may have a function of counting the number of operations of the limit switches 123 for a predetermined moving distance of the belts 4 to determine the frequency of slack 65*a* formation and of changing the mode of controlling, if the frequency becomes greater than a predetermined rate, according to which the first and second pressures of the cylinders 26 are alternately changed each time the belts 4 move a predetermined distance as in the first preferred embodiment.

Figure 29:
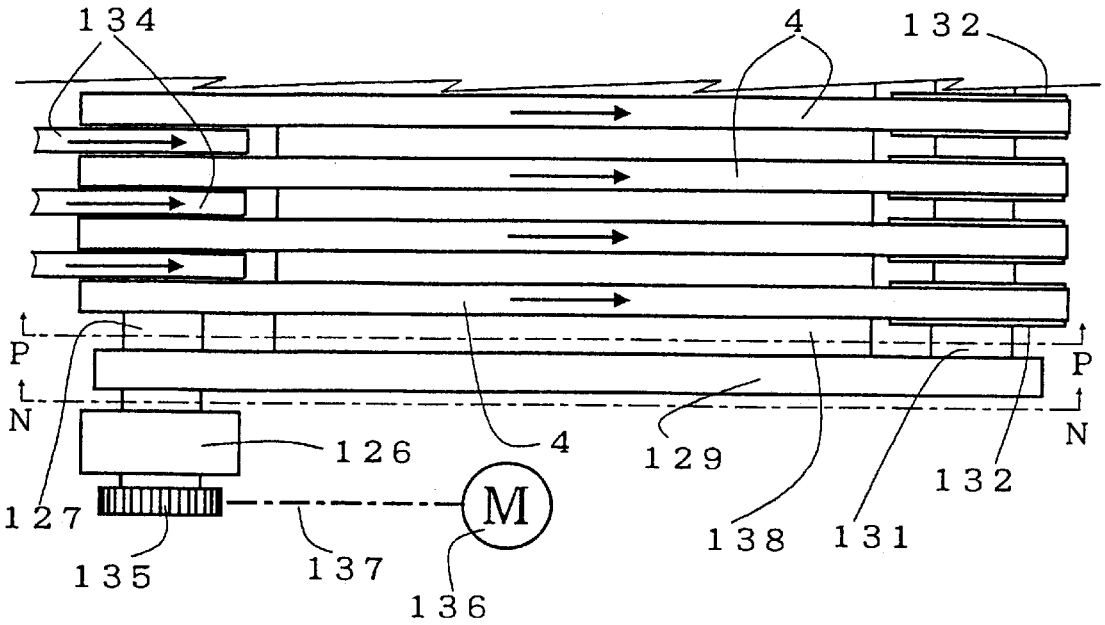
FIG. 29 is a fragmentary plan view showing still another embodiment of veneer reeling apparatus according to the present invention.
Figure 30:
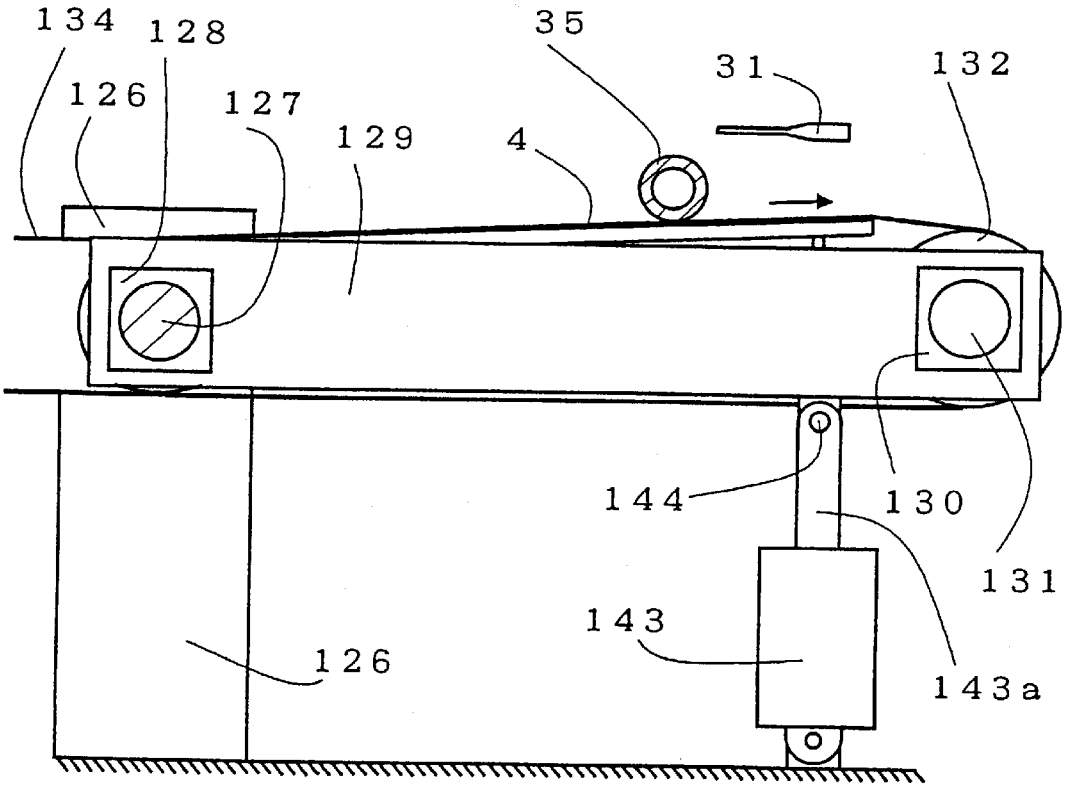
FIG. 30 is a side view as seen in arrow direction from dash-and-dot line N—N of FIG. 29.
Figure 31:
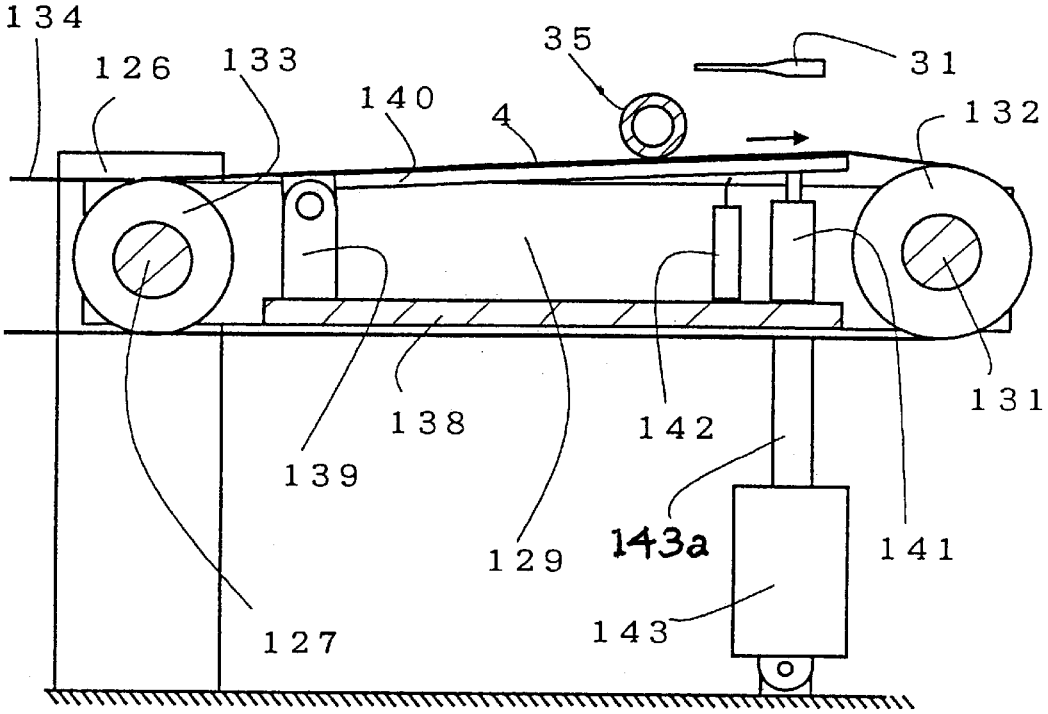
FIG. 31 is a side view as seen in arrow direction from dash-and-dot line P—P of FIG. 29.

Modified embodiment of FIGS. 29, 30 and 31 differs from the above-described embodiments in that the take-up reel 35 is provided stationary, but the conveyer belts 4 are movable with a diametrical increase of veneer roll 66. In the drawings, reference numeral 126 designates a pair of uprights disposed on opposite sides of an array of conveying belts 4. These belts 4 are arranged into two groups as in the above embodiments. A freely rotatable shaft 127 is supported at its end portions by bearings (not shown) in the uprights 126 and a pair of arms 129 (only one shown) is swingably mounted at the proximal ends thereof on the shaft 127 via bearings 128. A shaft 131 is freely rotatably supported by bearings 130 in the distal end portion of each arm 129 and carries thereon a series of spaced pulleys 132, namely as many as 16 pulleys. On the other hand, the shaft 127 carries thereon the same number of pulleys 133 (FIG. 31) and each of the belts 4 is trained round the corresponding pulleys 132 and 133. Though not shown fully in the drawings, a pulley is mounted on the shaft 127 between each two adjacent pulleys 133 and a belt 134 is trained over the former pulley and its corresponding pulley (not shown) located at upstream end of the upper leg of the belt 134. A sprocket wheel 135 is fixed on one end of the shaft 127 and operatively connected to a motor 136 by chain 137 for driving the shaft 127, thus moving the conveyer belts 4 and 134 in arrow direction. A support plate 138 is attached between the arms 129 at their bottoms for swinging therewith. A plate 140, similar to the plate 28 of the first and second embodiments, having the same width as the belt 4 is disposed just below each belt 4 and supported swingably about a bearing 139. An air cylinder 141 is fixed on the above support plate 138 at such a position that its piston rod, when extended, is engageable with the lower surface of each plate 140 at its distal end portion. These air cylinders 141 are grouped to correspond to the first and second groups of conveyer belts 4 and arranged in the manner as described with reference to FIG. 5 so that the cylinders 141 are alternately supplied with the first and second pressures. Two limit switches 142 (only one shown) are also fixed on the support plate 138 just below the plates 140 at the opposite outermost sides of the array of belts 4. Furthermore, below each of the swingable arms 129 is provided another air cylinder 143 having its piston rod 143*a* connected by a pin 144 to the bottom of the arm 129. Each air cylinder 143 is charged with air under pressure of such a magnitude that allows its piston rod 143*a* to be fully extended and support the swingable arm 129 substantially horizontally as shown in FIG. 30. After thus being charged with air under pressure, the inlet port of the cylinder 143 is closed. It is noted that the take-up reel 35 is supported at a position shown in FIGS. 30 and 31 and it remains in that position without moving vertically during veneer reeling operation. As veneer reeling is initiated and veneer roll 66 grows gradually to increase its diameter, the force with which the veneer roll 66 presses against the belts 4 is increased and the belts and the plates 140 are forced down gradually from the initial position to reduce the spaced distance between the plates 140 and the support plate 138. When the plates 140 are moved enough to strike the limit switch 142 on the support plate 138, the control (not shown) then responding to a signal from the limit switch 142 generates a command signal to open the outlet port of the cylinders 143 thereby to reduce the air pressure therein. The piston rod 143*a* is moved into the cylinder 143 and the arms 129 are swung downward together with the pulleys 132. Though the spaced distance between the support plate 138 and the veneer roll 66 is increased, the plates 140 urged upward by the cylinders 141 are not lowered with the arms 129, so that the limit switches 142 are moved away from the plates 140 and then clear thereof. The control then responding to a signal from the limit switches 142 cleared of the plates 140 is operated to close the outlet port of the cylinders 143 and, therefore, the movement of the piston rod 143*a* into the cylinder 143 is stopped. Accordingly, the arms 129 stop their downward swinging and supported by the cylinders 143 at a position slightly lowered from the initial horizontal position. Each time the veneer roll 66 becomes large enough to actuate the limit switch 142, the above operation is repeated to lower the arms 129 gradually. After a complete veneer roll 66 is formed and removed from the apparatus, the cylinders 143 are recharged with air under the above pressure for the next reeling operation.

As a modification of the first and second embodiments, it may be so arranged that each of two groups of belts 4 is arranged by any selected number of belts as counted from the respective lateral sides of the array of belts and air cylinders 26 operable by the first and second pressures are associated with these selected belts 4 of the two groups. In such a case, air pressure charged in the air cylinders for the remaining intermediate belts 4, namely belts of the third group, remain unchanged and it may be of a magnitude which is about half that of the first pressure. Any desired pressure may be set for such intermediate cylinders depending on the condition of veneer sheets to be handled.

In the preceding embodiments, the first and second pressures are changed simultaneously such that when the air cylinders of one of the first and second groups are filled with the first pressure, the air cylinders of the other group are supplied with the second pressure, and vice versa. According to the invention, however, it may be so arranged that the changing between the first and second pressures of the air cylinders for the belts of the first and second groups is performed with such a delay of time that the changing from the first to second pressure takes place only after the changing the second pressure to the first pressure, so that the cylinders of both first and second groups are supplied with the first pressure before the pressure changing is completed. The same holds true in similar modification of the embodiment of FIGS. 25 and 26 using cams and springs instead of the cylinders. Namely, the cam profile may be contoured so as to effect a similar timing of pressure application.

According to the invention, the first to third embodiments may be modified in such a way that all the cylinders for the belts are normally operated under the first pressure, but it is reduced or alternatively zeroed for a predetermined length of time whenever a change signal is provided by the control. By thus reducing the pressure of all the cylinders, a veneer sheet formed with slack can be wound in a loose form round the take-up reel 35. When the first pressure to the cylinders is reduced or zeroed, the force necessary for frictionally driving the veneer roll 66 will reduced or zeroed, accordingly, and the veneer roll 66 will be slowed down. It is necessary, therefore, that the above predetermined period of time should be set short enough to have as little influence on the reeling operation as possible.

The magnitude the first pressure for the air cylinders 26, 93, 94, 95, 96 may be established as required in accordance with the species of veneer or thickness of veneer sheet to be handled for the belts to be pressed against the veneer roll 66 with an optimum pressure.

While the cylinder 19 acting on the load cell 20 in the first embodiment is charged with air under pressure the magnitude of which is such that the touch rolls 5 are pressed against the veneer roll 66 with a force of about 5 kilograms, this pressure may be changed as required depending on the species of veneer and the thickness of veneer sheet.

While in the above-described embodiments the first and second pressures of the cylinders for the belts of two different groups are alternately changed each time the belts have moved a distance of about 500 mm, this distance may be changed as required depending on the species of veneer or the thickness of veneer sheet to be reeled. Alternatively, changing between the first and second pressures may be performed after each elapse of a predetermined length of time, e.g. about two seconds.

In the first to third embodiments, it is required that the take-up reel 35 should make a quarter turn while the load cell 20 or the limit switch 86, 99, 100 remains its actuated state for the control to provide a command signal to the motor 41 to elevate the reel 35 and also to stop its elevation. If there exists no fear of a debris being wound with veneer sheet, however, the requirement of time for the take-up reel 35 to make a quarter turn may be eliminated. Alternatively, the time may be changed depending on working conditions.

The load cell 20 used in the first embodiment for detecting the force applied thereto for monitoring an increment in diameter of veneer roll 66 may be replaced by any suitable means such as piezoelectric-crystal switch.

Mechanism including screws 38 and their associated parts for controllably moving the take-up reel carriages 51 may be substituted by any suitable arrangement including, for example, chains which are trained over sprocket wheels and to which the carriages 51 are attached so that the take-up reel 35 carried by the carriages is moved by rotating the sprocket wheels by a motor. Alternatively, power for moving the reel carriages 51 may be supplied from air cylinders.

While the load cell 20, limit switches 86, 99, 100 or 142 are employed as means for detecting an increment of veneer roll diameter in the preceding embodiments, other detecting means such as light emitters and receivers arranged radially adjacent the opposite axial ends of a veneer roll may be used for the same purpose.

In the first and second embodiments, the touch rolls 5 are arranged to be freely rotatable and driven to rotate by frictional force from veneer roll 66. Depending on the species of veneer, the peripheral speed of veneer roll may be reduced relative to the conveying speed of the belts 4 because of resistance offered by the touch rolls 5, with the result that a difference may occur between the feeding speed of veneer sheet 65 moved by the belts 4 and the peripheral speed of veneer roll 66. Such difference in speed may cause slack in the veneer sheet, which may in turn produce harmful folds in the sheet. To prevent the touch rolls 5 from being slowed down, it may be so arranged that the touch rolls 5 are positively driven by a motor so that they are rotated in the same direction as the belts 4 and at a peripheral speed that is slightly higher than the traveling speed of the belts 4.

While in the above embodiments compensation for an increment in diameter of veneer roll 66 is accomplished by elevating the take-up reel carriages 51 relative to the belts 4, such elevating mechanism may be dispensed with by using, for example in the case of the embodiment of FIG. 18, an air cylinder 26 with a piston rod whose length of stroke is great enough to cover the growth in diameter of veneer roll 66.

As stated earlier, the take-up reel 35 is constructed heavy enough to resist upward force exerted by belts 4 and touch rolls 5. It may be so arranged that the bearings 33 at the opposite ends of the take-up reel shaft 35*a* are retained by any means such as plate disposed immediately above the bearings 33 and fixed to the carriage 51. V-shaped support surface 52 by bolts. By so arranging, the take-up reel 35 may be constructed lighter in weight.

While the invention has been described and illustrated with reference to the specific embodiments, it is to be understood that the present invention can be practiced in other various changes and modifications without departing from the spirit or scope thereof.

What is claimed is:

1. A veneer reeling apparatus for winding a veneer sheet into a veneer roll comprising:

a freely rotatable take-up reel around which the veneer sheet is wound into the veneer roll;

an array of spaced conveyer belts extending below said take-up reel in perpendicular relation to the axis of said reel for advancing the veneer sheet toward said take-up reel, said belts including a first group of at least one belt arranged on one lateral side of said array of belts and a second group of at least one belt arranged on the other lateral side of said array of belts;

pressing means arranged for each conveyer belt for providing a first force to urge at least the belts of said first and second groups toward said take-up reel so as to keep the belts in resiliently pressing contact with the veneer roll, said pressing means for the belts of said first and second groups being operable to changeably provide said first force for one group of at least one belt of said first and second groups and a second force which is smaller than said first force for the other group of at least one belt;

a control operable on said pressing means to controllably change the provision of said first or second force to one group or the other group of at least one belt.

2. A veneer reeling apparatus according to claim 1, wherein said second force has a magnitude of zero.

3. A veneer reeling apparatus according to claim 1, wherein said control is operable to generate a signal regularly to command the changing between said first and second forces from said pressing means for the belts of said first and second groups.

4. A veneer reeling apparatus according to claim 3, wherein said control generates said signal whenever the belts have moved a predetermined distance.

5. A veneer reeling apparatus according to claim 4, wherein said predetermined distance is about 500 mm.

6. A veneer reeling apparatus according to claim 3, wherein said control generates said signal after each elapse of a predetermined length of time.

7. A veneer reeling apparatus according to claim 3, wherein the changing between said first and second forces from said pressing means for the belts of said first and second groups takes place in an alternate manner.

8. A veneer reeling apparatus according to claim 3, wherein the changing between said first and second forces from said pressing means for the belts of said first and second groups is performed with a such time-lag that the changing from the first to second force takes place only after the changing the second to first force.

9. A veneer reeling apparatus according to claim 1, wherein said pressing means includes a swingable plate disposed on underside of the belt and an air cylinder with a piston rod which is operable on the belt by way of said swingable plate.

10. A veneer reeling apparatus according to claim 1, wherein said pressing means includes a swingable plate disposed on underside of the belt, a compression spring below said swingable plate and a cam which is operable on the belt by way of said compression spring and said swingable plate.

11. A veneer reeling apparatus according to claim 1, wherein said array of belts include a third group of at least one belt between said first and second groups of belts and said pressing means provides said first force to urge said at least one belt of said third group toward said take-up reel so as to keep the belt in resiliently pressing contact with the veneer roll.

12. A veneer reeling apparatus according to claim 1, wherein said array of belts include a third group of at least one belt between said first and second groups of belts and said pressing means provides a force to urge said at least one belt of said third group toward said take-up reel so as to keep the belt in resiliently pressing contact with the veneer roll, said force being smaller than said first force and greater than said second force.

13. A veneer reeling apparatus according to claim 1, further comprising means for moving said take-up reel toward and away from said belts and means for detecting an increment in diameter of the veneer roll during reeling operation, said detecting means operable to generate a signal in response to detection of a predetermined amount of increment in diameter of the veneer roll, said control being operable in response to the signal from said detecting means to generate a command signal to activate said take-up reel moving means thereby to move said take-up reel away from the belts so as to compensate for the increment in diameter of the veneer roll.

14. A veneer reeling apparatus according to claim 1, further comprising means for moving said belts toward and away from said take-up reel and means for detecting an increment in diameter of the veneer roll during reeling operation, said detecting means operable to generate a signal in response to detection of a predetermined amount of increment in diameter of the veneer roll, said control being operable in response to the signal from said detecting means to generate a command signal to activate said belt moving means thereby to move said belts away from the take-up reel so as to compensate for the increment in diameter of the veneer roll.

15. A veneer reeling apparatus for winding a veneer sheet into a veneer roll comprising:

a freely rotatable take-up reel around which the veneer sheet is wound into the veneer roll;

an array of spaced conveyer belts extending below said take-up reel in perpendicular relation to the axis of said reel for advancing the veneer sheet toward said take-up reel;

pressing means arranged for each conveyer belt for normally providing a first force to urge each such belt toward said take-up reel so as to keep the belt in resiliently pressing contact with the veneer roll, said pressing means being operable to changeably provide said first force and a second force which is smaller than said first force;

a control operable regularly on said pressing means to change said first force to said second force.

16. A veneer reeling apparatus according to claim 15, wherein said second force has a magnitude of zero.

17. A veneer reeling apparatus for winding a veneer sheet into a veneer roll comprising:

a freely rotatable take-up reel around which the veneer sheet is wound into the veneer roll;

an array of spaced conveyer belts extending below said take-up reel in perpendicular relation to the axis of said reel for advancing the veneer sheet toward said take-up reel;

pressing means arranged for each conveyer belt for normally providing a first force to urge each such belt toward said take-up reel so as to keep the belt in resiliently pressing contact with the veneer roll, said pressing means being operable to changeably provide said first force and a second force which is smaller than said first force;

means provided adjacent each lateral side of said array of belts for detecting the presence of any raised portion in veneer sheet caused by slack thereof and operable to generate a signal if such raised portion is detected thereby;

a control operable in response to said signal on the pressing means adjacent the detecting means which generated said signal to change the first to the second force until said raised portion disappears.

18. A veneer reeling apparatus according to claim 17, wherein said second force has a magnitude of zero.

* * * * *

UNITED STATES PATENT AND TRADEMARK OFFICE
CERTIFICATE OF CORRECTION

PATENT NO. : 5,988,558

DATED : November 23, 1999

INVENTOR(S) : Masaru KOIKE et al.

It is certified that error appears in the above-identified patent and that said Letters Patent is hereby corrected as shown below:

Column 13, line 4, change "switch 83" to --switches 86--.

Column 13, lines 54 ,and 60, after "limit" change "switch" to --switches--.

Column 16, line 27, after "valves" change "131" to --81--; line 28, change "encoders" to --encoder--.

Column 17, line 30, after "pulleys" change "97, 98" to --90, 91--; same line, after "belts" change "90, 91" to --97, 98--.

Column 19, line 4, change "not:" to --not--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*